US008277266B2

(12) United States Patent
Inoue et al.

(10) Patent No.: US 8,277,266 B2
(45) Date of Patent: Oct. 2, 2012

(54) OUTBOARD MOTOR AND MARINE VESSEL INCLUDING THE SAME

(75) Inventors: Hiroshi Inoue, Shizuoka (JP); Yoshikazu Watanabe, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 102 days.

(21) Appl. No.: 13/028,320

(22) Filed: Feb. 16, 2011

(65) Prior Publication Data

US 2011/0281477 A1 Nov. 17, 2011

(30) Foreign Application Priority Data

May 13, 2010 (JP) ..... 2010-111105

(51) Int. Cl.
*B63H 21/22* (2006.01)

(52) U.S. Cl. ..... 440/1; 440/61 T

(58) Field of Classification Search ..... 440/1, 61 T
See application file for complete search history.

(56) References Cited

U.S. PATENT DOCUMENTS

| | | | | |
|---|---|---|---|---|
| 4,861,291 | A * | 8/1989 | Koike | 440/1 |
| 6,042,434 | A * | 3/2000 | Nakamura | 440/61 R |
| 6,398,601 | B1 * | 6/2002 | Oguma | 440/53 |
| 6,691,023 | B2 * | 2/2004 | Fujino et al. | 701/114 |
| 7,699,673 | B2 * | 4/2010 | Kawanishi et al. | 440/1 |
| 2002/0146945 | A1 * | 10/2002 | Saito | 440/61 |
| 2003/0077953 | A1 * | 4/2003 | Kaji | 440/1 |
| 2003/0082963 | A1 * | 5/2003 | Motose et al. | 440/2 |
| 2003/0157848 | A1 * | 8/2003 | Saito | 440/61 T |
| 2004/0121661 | A1 * | 6/2004 | Okuyama | 440/1 |
| 2005/0250394 | A1 * | 11/2005 | Nakamura et al. | 440/53 |
| 2006/0052013 | A1 * | 3/2006 | Takada et al. | 440/1 |

FOREIGN PATENT DOCUMENTS

| | | | |
|---|---|---|---|
| JP | 07-115671 | B2 | 12/1995 |
| JP | 2913228 | B2 | 6/1999 |
| JP | 2001-001988 | A | 1/2001 |
| JP | 2001-001990 | A | 1/2001 |

* cited by examiner

*Primary Examiner* — Stephen Avila
(74) *Attorney, Agent, or Firm* — Keating & Bennett, LLP

(57) ABSTRACT

An outboard motor includes an outboard motor main body, an attachment mechanism, a pivoting mechanism, an angle detecting device, a rotation speed detecting device, and a controller. The pivoting mechanism includes a first cylinder arranged to support and pivot the outboard motor main body about a horizontal shaft from a first angle to a second angle greater than the first angle. An angle detection value and a speed detection value are input into the controller. The controller is arranged to execute a speed reduction control to control the engine so as to reduce the engine speed. The controller is arranged not to execute the speed reduction control when the angle detection value is a value corresponding to the inclination angle less than the first angle or a value corresponding to the inclination angle greater than the second angle.

9 Claims, 10 Drawing Sheets

OUTBOARD MOTOR AND MARINE VESSEL INCLUDING THE SAME

BACKGROUND OF THE INVENTION

1. Field of the Invention

The present invention relates to an outboard motor and a marine vessel including the same.

2. Description of the Related Art

An outboard motor is an example of a propulsion machine included in amarine vessel. A conventional outboard motor is described in U.S. Pat. No. 4,861,291. The outboard motor includes an outboard motor main body that generates a propulsive force by rotating a propeller by means of an engine. The outboard motor main body is supported by a swivel bracket via a steering shift. The swivel bracket is supported by a support bracket via a horizontal shaft. The support bracket is fixed to a hull. The outboard motor main body and the swivel bracket are pivotable up and down about the horizontal shaft with respect to the support bracket.

The outboard motor main body and the swivel bracket are pivoted up and down about the horizontal shaft within a trim range by a trim cylinder. The outboard motor main body and the swivel bracket are also pivoted up and down about the horizontal shaft within a tilt range, which is larger than the trim range, by a tilt cylinder. The outboard motor main body and the swivel bracket are supported by a trim rod of the trim cylinder and the tilt rod of the tilt cylinder. An inclination angle of the outboard motor main body and the swivel bracket is detected by an angle detection value being input from a trim sensor into a controller.

The tilt rod is coupled to the swivel bracket. On the other hand, the trim rod is not coupled to the swivel bracket and the outboard motor main body and the swivel bracket are put in contact with the trim rod by their own weight. Thus, when the inclination angle of the outboard motor main body and the swivel bracket increases and reaches the tilt range, the supporting of the outboard motor main body and the swivel bracket by the trim rod is released and the outboard motor main body and the swivel bracket are supported only by the tilt rod. In U.S. Pat. No. 4,861,291, when an engine speed exceeds a speed threshold in a state in which the outboard motor main body and the swivel bracket are tilted up (in a state in which the inclination angle is within the tilt range), the controller makes the engine misfire to reduce the engine speed.

SUMMARY OF THE INVENTION

The inventors of preferred embodiments of the present invention described and claimed in the present application conducted an extensive study and research regarding an outboard motor and a marine vessel including the same, such as the one described above, and in doing so, discovered and first recognized new unique challenges and previously unrecognized possibilities for improvements as described in greater detail below.

Specifically, for example, in order to prevent a lower end of the outboard motor main body from contacting a shallow bottom when a marine vessel travels through a shallow water region or in order to lift and bring a stem of the marine vessel above a water surface and onto land in bringing the marine vessel out of the water and onto land, the marine vessel is propelled forward with the outboard motor main body and the swivel bracket being tilted up. In this state, the propeller is close to the water surface and thus, for example, if the water surface is very wavy, the propeller enters and exits in and out of the water. When the propeller is in the air instead of in the water, a resistance of the water is not applied to the propeller. Thus, when the propeller is in the air instead of the water, a rotation speed of the propeller increases even if an opening degree of a throttle valve provided in the engine is fixed. When the propeller reenters the water in such a state, a large propulsive force that drives the hull forward is suddenly applied to the outboard motor main body and the swivel bracket. Also, even if the propeller is underwater, when the rotation of the propeller is rapidly accelerated by increasing the opening degree of the throttle valve, a large propulsive force that drives the hull forward is suddenly applied to the outboard motor main body and the swivel bracket.

In the state in which the outboard motor main body and the swivel bracket are tilted up, the supporting of the outboard motor main body and the swivel bracket by the trim rod is released and these components are supported only by the tilt rod. When the outboard motor main body and the swivel bracket are supported by the tilt rod, the propulsive force generated by the outboard motor main body is transmitted to the tilt rod. Thus, in the state in which the outboard motor main body and the swivel bracket are tilted up, a large load is applied to the tilt rod. In a case in which the tilt cylinder is, for example, a hydraulic cylinder, a pressure inside the tilt cylinder increases when a large load is applied to the tilt rod. Hydraulic oil is thus discharged from inside the tilt cylinder via a relief valve, etc., connected to the tilt cylinder and a projection amount of the tilt rod decreases. The load applied to the tilt rod is thereby reduced. However, when a sudden load is applied to the tilt rod, pressure release by the relief valve lags behind and a large load is applied to the tilt rod because the load applied to the tilt rod is not adequately reduced.

With the outboard motor according to U.S. Pat. No. 4,861,291, when the engine speed exceeds the speed threshold in the state in which the outboard motor main body and the swivel bracket are tilted up, the controller causes the engine to misfire to reduce the engine's speed. Sudden application of a large propulsive force to the outboard motor main body when the outboard motor main body and the swivel bracket are tilted up is thus prevented with the outboard motor according to U.S. Pat. No. 4,861,291. Application of a large load to the tilt rod is thereby prevented. However, with the outboard motor according to U.S. Pat. No. 4,861,291, the inclination angle of the outboard motor main body and the swivel bracket is detected by the angle detection value input from the trim sensor into the controller. Thus, when, for example, a fault occurs in the trim sensor, a value differing from the angle detection value corresponding to the actual inclination angle of the outboard motor main body and the swivel bracket may be input into the controller and the outboard motor main body and the swivel bracket may thereby be erroneously judged as being tilted up even when these components are not tilted up. Thus, for example, the engine speed may forcibly be reduced so that an adequate propulsive force cannot be obtained even when the outboard motor main body and the swivel bracket are not tilted up during ordinary marine vessel running, etc.

In order to overcome the previously unrecognized and unsolved challenges described above, a preferred embodiment of the present invention provides an outboard motor including an outboard motor main body, an attachment mechanism, a pivoting mechanism, an angle detecting device, a rotation speed detecting device, and a controller. The outboard motor main body includes an engine which is arranged to generate a propulsive force that propels a hull. The attachment mechanism includes at least a fixed member arranged to be fixed to the hull and a horizontal shaft coupled to the fixed member. The attachment mechanism is arranged to attach the outboard motor main body to the hull such that the outboard motor main body pivots about the horizontal shaft. The pivoting mechanism includes a first cylinder arranged to support and pivot the outboard motor main body about the horizontal shaft from a first angle to a second angle greater than the first angle. The pivoting mechanism is arranged to pivot the outboard motor main body about the horizontal shaft to incline the outboard motor main body with respect to the fixed member. The angle detecting device is arranged to output an angle detection value corresponding to an inclination angle of the outboard motor main body with respect to the fixed member. The angle detecting device is arranged to output the angle detection value corresponding to the inclination angle less than the first angle or the angle detection value corresponding to the inclination angle greater than the second angle when an abnormality occurs in the angle detecting device. The rotation speed detecting device is arranged to output a speed detection value corresponding to an engine speed of the engine. The controller is arranged to acquire the angle detection value output by the angle detecting device and the speed detection value output by the rotation speed detecting device. The controller is arranged to execute, in accordance with the angle detection value and the speed detection value, a speed reduction control to control the engine so as to reduce the engine speed. The controller is arranged not to execute the speed reduction control when the angle detection value is a value corresponding to the inclination angle less than the first angle or a value corresponding to the inclination angle greater than the second angle.

With the arrangement of the present preferred embodiment, the outboard motor main body is attached to the hull by the attachment mechanism. The attachment mechanism includes at least the fixed member arranged to be fixed to the hull and the horizontal shaft coupled to the fixed member. The outboard motor main body is attached to the hull by the attachment mechanism such that the outboard motor main body pivots about the horizontal shaft. The outboard motor main body is pivoted about the horizontal shaft by the pivoting mechanism. The outboard motor main body is thereby inclined with respect to the fixing member. The angle detection value corresponding to the inclination angle of the outboard motor main body with respect to the fixed member is input from the angle detecting device into the controller. Also, the speed detection value corresponding to the engine speed is input from the rotation speed detecting device into the controller. The pivoting mechanism includes the first cylinder arranged to support and pivot the outboard motor main body about the horizontal shaft. The first cylinder supports and pivots the outboard motor main body about the horizontal shaft from the first angle to the second angle greater than the first angle.

When an abnormality occurs in the angle detecting device, the angle detecting device outputs the angle detection value corresponding to the inclination angle less than the first angle or the angle detection value corresponding to the inclination angle greater than the second angle. The controller executes, in accordance with the angle detection value input from the angle detecting device and the speed detection value input from the speed detecting device, the speed reduction control to control the engine so as to reduce the engine speed. Specifically, the controller does not execute the speed reduction control when the angle detection value is the value corresponding to the inclination angle less than the first angle or the value corresponding to the inclination angle greater than the second angle. That is, the speed reduction control is not executed when an abnormality occurs in the angle detecting device. Thus, forcible reduction in the propulsive force is prevented when, for example, the outboard motor is driven forward at an ordinary speed. An adequate propulsive force can thus be obtained when necessary.

The pivoting mechanism may include a second cylinder arranged to support and pivot the outboard motor main body about the horizontal shaft from the first angle to a third angle greater than the first angle and less than the second angle. The controller may be arranged to execute the speed reduction control when the angle detection value is a value corresponding to the inclination angle greater than the third angle and not more than the second angle, and the speed detection value exceeds a first speed value. The controller may be arranged not to execute the speed reduction control when the angle detection value is a value corresponding to the inclination angle not less than the first angle and not more than the third angle.

With the arrangement of the present preferred embodiment, the pivoting mechanism includes, in addition to the first cylinder, the second cylinder that supports and pivots the outboard motor main body about the horizontal shaft. The second cylinder supports and pivots the outboard motor main body from the first angle to the third angle that is greater than the first angle and less than the second angle about the horizontal shaft. Thus, when the inclination angle of the outboard motor main body is greater than the third angle, the second cylinder is separated from the outboard motor main body and the supporting of the outboard motor main body by the second cylinder is released. Thus, a load that is greater than that when the outboard motor main body is supported by the first cylinder and the second cylinder is applied to the first cylinder. Also, the propulsive force generated by the outboard motor main body increases with an increase in the engine speed. The load applied to the first cylinder thus increases with the increase in the engine speed. The application of a large load to the first cylinder is thus prevented by the speed reduction control being executed when the angle detection value is a value corresponding to the inclination angle greater than the third angle and not more than the second angle and the speed detection value exceeds the first speed value.

Also, the first speed value may be a speed detection value corresponding to the engine speed when a load, applied from the outboard motor main body to the pivoting mechanism in a state in which the inclination angle of the outboard motor main body is the second angle, is less than a load at which at least one component among the pivoting mechanism, the attachment mechanism, and the hull breaks. The "load applied from the outboard motor main body to the pivoting mechanism in a state in which the inclination angle of the outboard motor main body is the second angle" is a load applied to the pivoting mechanism in a state in which a propeller is positioned underwater.

When the outboard motor main body generates a propulsive force, the propulsive force is transmitted from the outboard motor main body to the pivoting mechanism. Also, the propulsive force transmitted to the pivoting mechanism is transmitted to the attachment mechanism and the hull. Thus, when the outboard motor main body generates the propulsive force, a load is transmitted to the pivoting mechanism, the attachment mechanism, and the hull. With the arrangement of the present preferred embodiment, the engine speed is controlled so that the load applied to the pivoting mechanism, the attachment mechanism, and the hull is less than the load at which at least one component among the pivoting mechanism, the attachment mechanism, and the hull breaks. Breakage of the pivoting mechanism, the attachment mechanism, and the hull is thereby prevented. Specifically, for example, deformation of a rod of the first cylinder of the pivoting mechanism or damaging of the first cylinder is prevented. Also, for example, deformation of the fixed member or the horizontal shaft of the attachment mechanism is prevented. Also, for example, deformation or breakage of a rear portion (transom) of the hull is prevented.

Also, the controller may be arranged to vary the first speed value based on the angle detection value input from the angle detecting device. With the arrangement of the present preferred embodiment, the controller varies the first speed value based on the inclination angle of the outboard motor main body. In this case, the first speed value may be a speed detection value corresponding to the engine speed when the load, applied from the outboard motor main body to the pivoting mechanism in the state in which the inclination angle of the outboard motor main body is greater than the third angle and not more than the second angle, is less than the load at which at least one component among the pivoting mechanism, the attachment mechanism, and the hull breaks. The first speed value may include a plurality of values. Each of the plurality of values may be determined according to the inclination angle of the outboard motor main body. That is, the first speed value may be a variable that varies according to the inclination angle of the outboard motor main body.

Also, the controller may be arranged to execute the speed reduction control when the speed detection value exceeds the first speed value, and the angle detection value is a value corresponding to the inclination angle that is not more than the second angle and not less than a fourth angle, which is greater than the third angle and less than the second angle.

Also, the controller may be arranged not to execute the speed reduction control if the angle detection value input from the angle detecting device does not differ before and after the pivoting mechanism pivots the outboard motor main body. With the arrangement of the present preferred embodiment, the controller compares the angle detection value input from the angle detecting device before the pivoting mechanism pivots the outboard motor main body and the angle detection value input from the angle detecting device after the pivoting mechanism pivots the outboard motor main body. If the angle detecting device is operating normally, the angle detection value changes before and after the pivoting mechanism pivots the outboard motor main body. The controller can thus judge whether or not the angle detecting device is operating normally by judging whether or not the angle detection value changes before and after the pivoting mechanism pivots the outboard motor main body.

In a case in which the controller judges that the angle detecting device is not operating normally, the controller does not execute the speed reduction control. That is, in the case in which the controller judges that the angle detecting device is not operating normally, the controller does not forcibly reduce the engine speed. Thus, for example, forcible reduction in the propulsive force due to an abnormality (for example, seizing) of the angle detecting device can be prevented when the outboard motor is driving the hull forward at an ordinary speed. An adequate propulsive force can thereby be obtained when necessary.

Also, the outboard motor main body may include a forward-reverse switching mechanism arranged to switch among a plurality of states that include a forward drive state and a reverse drive state. The controller may be arranged not to execute the speed reduction control when the forward-reverse switching mechanism is not in the forward drive state.

With the arrangement of the present preferred embodiment, the outboard motor main body includes the forward-reverse switching mechanism. The forward-reverse switching mechanism switches among the plurality of states that include the forward drive state, in which the outboard motor main body generates a forward driving force that propels the hull forward, and the reverse drive state, in which the outboard motor main body generates a reverse driving force that propels the hull in reverse. When the forward-reverse switching mechanism is not in the forward drive state, the controller does not execute the speed reduction control. Thus, the engine speed is not reduced forcibly when the forward-reverse switching mechanism is in the reverse drive state and the outboard motor main body generates the reverse driving force that propels the hull in reverse. Forcible reduction in the propulsive force (reverse driving force) can thus be prevented when the outboard motor is driving the hull in reverse.

Another preferred embodiment of the present invention provides a marine vessel including the outboard motor and a hull to which the outboard motor is attached. With this arrangement, the same effects as the above-mentioned effects can be achieved.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
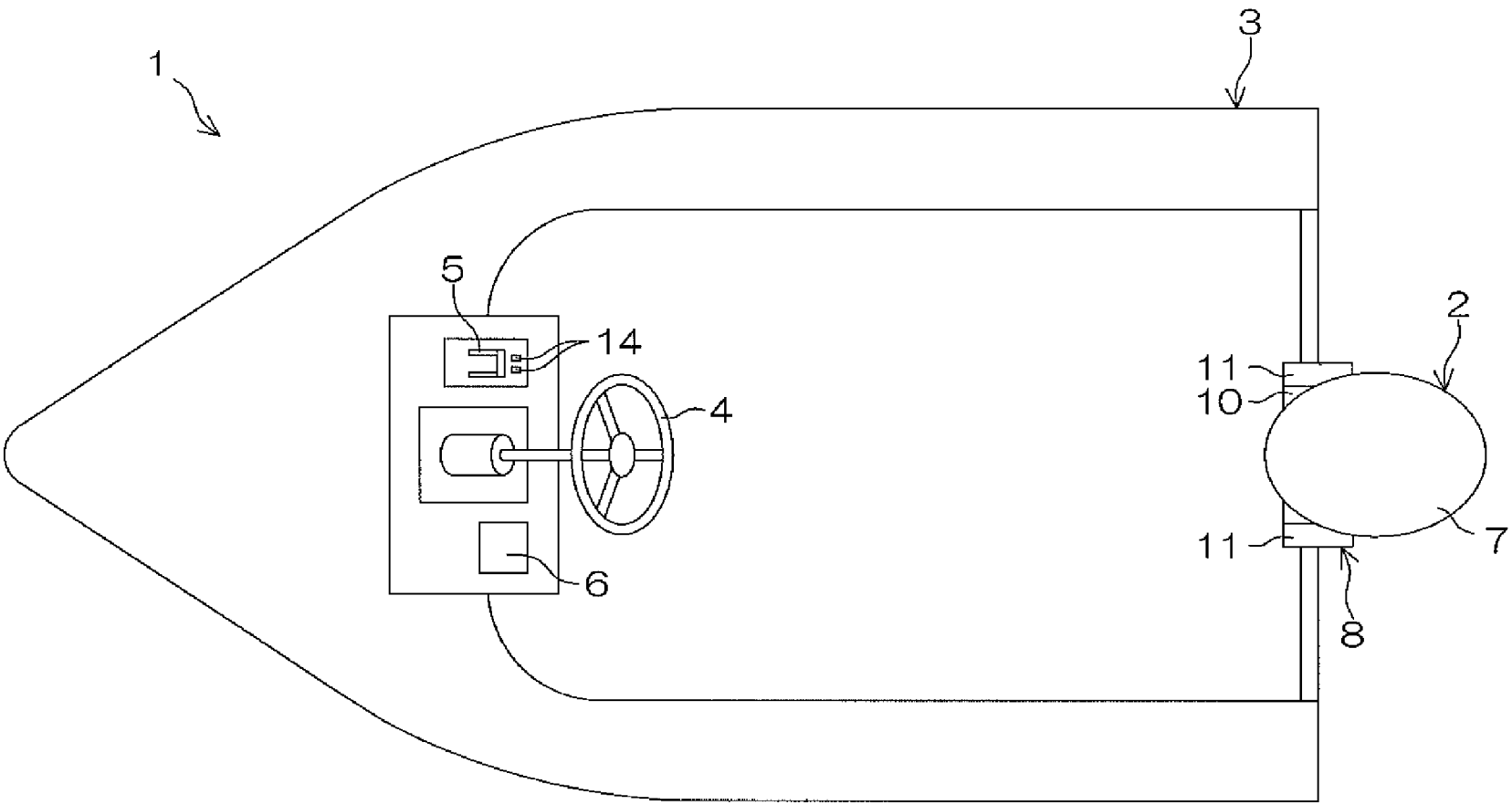
FIG. 1 is a conceptual diagram for explaining an arrangement of a marine vessel according to a preferred embodiment of the present invention.

FIG. 1 is a conceptual diagram for explaining an arrangement of a marine vessel 1 according to a preferred embodiment of the present invention.

The marine vessel 1 includes the outboard motor 2 and the hull 3. The outboard motor 2 is attached to a rear portion of the hull 3. The hull 3 is propelled by the outboard motor 2. The hull 3 includes a steering member 4, a control lever 5, and a display portion 6. The marine vessel 1 is steered by the steering member 4 being operated. A speed of the marine vessel 1 is adjusted by the control lever 5 being operated. Switching between forward drive and reverse drive of the marine vessel 1 is performed by the control lever 5 being operated. The speed and other conditions of the marine vessel 1 are displayed on the display portion 6.

Figure 2:
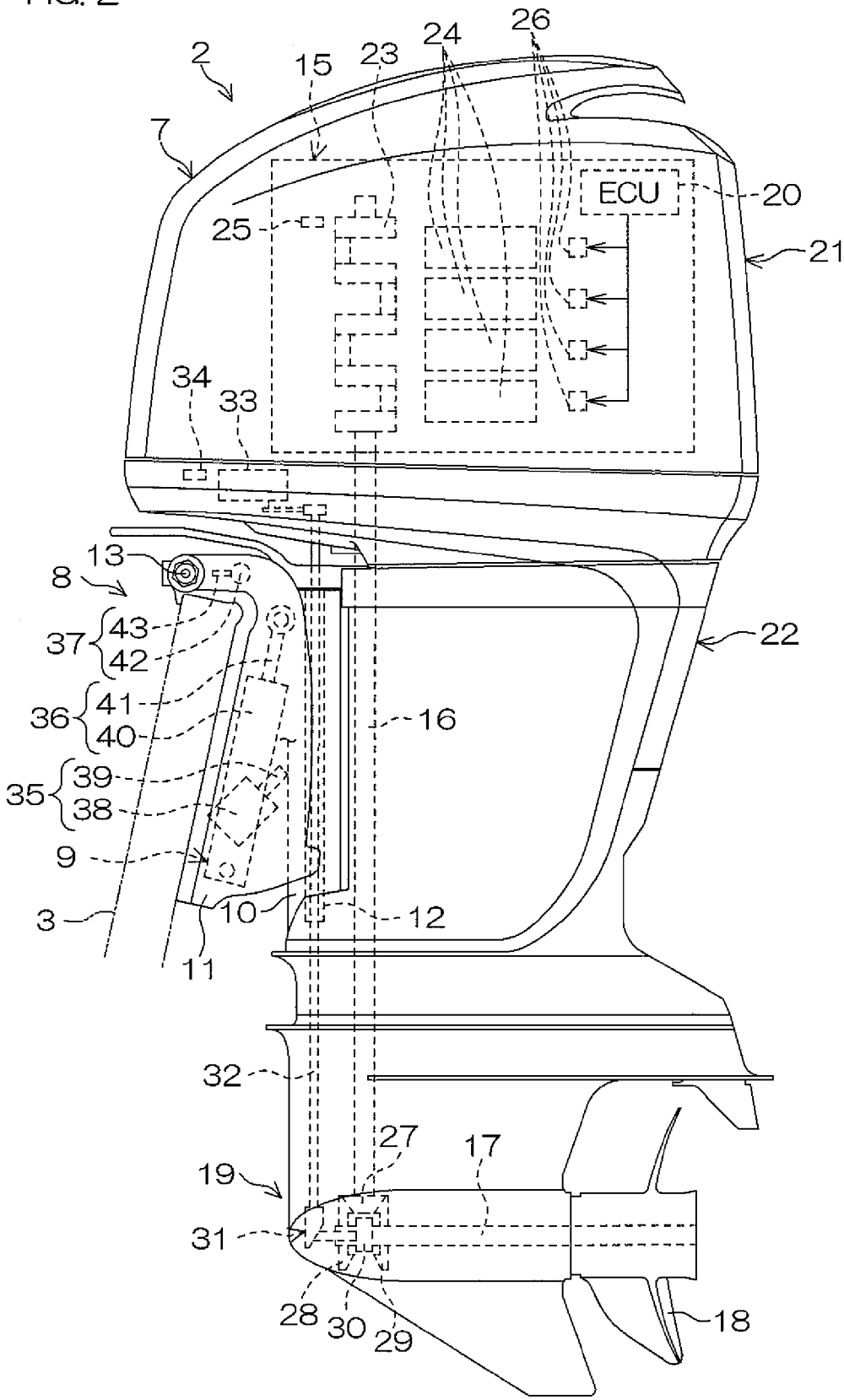
FIG. 2 is a side view of an outboard motor according to a preferred embodiment of the present invention.

FIG. 2 is a side view of the outboard motor 2 according to a preferred embodiment of the present invention.

The outboard motor 2 includes an outboard motor main body 7, an attachment mechanism 8, and a power trim and tilt mechanism 9 (hereinafter, referred to as the "PTT mechanism 9"). The outboard motor main body 7 is attached to a rear portion of the hull 3 by the attachment mechanism 8. The attachment mechanism 8 includes a swivel bracket 10, two clamp brackets 11 (see FIG. 1), a steering shaft 12, and a tilt shaft 13. The steering shaft 12 is disposed so as to extend vertically. The tilt shaft 13 is disposed horizontally so as to extend to the right and left. The swivel bracket 10 is coupled to the outboard motor main body 7 via the steering shaft 12. Each clamp bracket 11 is coupled to the swivel bracket 10 via the tilt shaft 13. Each clamp bracket 11 is fixed to the rear portion (transom) of the hull 3. The two clamp brackets 11 are disposed across an interval in a right/left direction. A portion of the swivel bracket 10 and the PTT mechanism 9 are disposed between the two clamp brackets 11.

The outboard motor main body 7 is attached in a substantially vertical orientation to the hull 3 by the attachment mechanism 8. The outboard motor main body 7 and swivel bracket 10 are pivotable about the tilt shaft 13 with respect to the clamp brackets 11. The outboard motor main body 7 and the swivel bracket 10 are pivoted up and down about the tilt shaft 13 by the PTT mechanism 9 when a PTT operation switch 14 (see FIG. 1) is operated. The outboard motor main body 7 is thereby inclined with respect to the hull 3 and the clamp brackets 11. Also, the outboard motor main body 7 is pivotable to the right and left about the steering shaft 12 with respect to the swivel bracket 10 and the clamp brackets 11. The outboard motor main body 7 is pivoted to the right and left about the steering shaft 12 by the steering member 4 (see FIG. 1) being operated. The marine vessel 1 is thereby steered.

The outboard motor main body 7 includes an engine 15, a driveshaft 16, a propeller shaft 17, a propeller 18, a forward-reverse switching mechanism 19, and an ECU 20 (Electronic Control Unit). The outboard motor main body 7 also includes an engine cover 21 and a casing 22. The engine 15 and the ECU 20 are housed inside the engine cover 21. The driveshaft 16 extends vertically inside the engine cover 21 and the casing 22. The propeller shaft 17 extends to the front and rear inside a lower portion of the casing 22. An upper end portion of the driveshaft 16 is coupled to the engine 15. A lower end portion of the driveshaft 16 is coupled to a front end portion of the propeller shaft 17 by the forward-reverse switching mechanism 19. A rear end portion of the propeller shaft 17 protrudes rearward from the casing 22. The propeller 18 is coupled to the rear end portion of the propeller shaft 17. The propeller 18 rotates together with the propeller shaft 17. The propeller 18 is driven to rotate by the engine 15.

The engine 15 is an internal combustion engine that generates power by combustion of a fuel, such as gasoline, for example. The engine 15 includes a crankshaft 23, a plurality (for example, four) of cylinders 24, and a rotation speed detecting device 25. The engine 15 is disposed so that the crankshaft 23 extends vertically. The upper end portion of the driveshaft 16 is coupled to the crankshaft 23. The crankshaft 23 is driven to rotate about a vertical axis by the combustion in the respective cylinders 24. A rotation speed of the crankshaft 23 (engine speed of the engine 15) is detected by the rotation speed detecting device 25 and the ECU 20. That is, the rotation speed detecting device 25 outputs a speed detection value corresponding to the rotation speed of the crankshaft 23. The ECU 20 computes the engine speed of the engine 15 from the speed detection value input from the rotation speed detecting device 25.

The engine 15 includes a plurality of spark plugs, respectively attached to the plurality of cylinders 24, and a plurality (for example, four) of ignition coils 26, respectively attached to the plurality of spark plugs. The engine 15 also includes a plurality of intake pipes, respectively connected to the plurality of cylinders 24, and fuel injectors and throttle valves provided in the respective intake pipes. The ECU 20 causes each ignition coil 26 to generate a high voltage. The high voltage is thereby applied to the corresponding spark plug and a spark is generated in the corresponding cylinder 24. A mixed gas of fuel and air is thus combusted inside each cylinder 24. The mixed gas is supplied from each intake pipe into the corresponding cylinder 24. The ECU 20 controls an opening degree of each throttle valve to adjust a supply flow rate of the mixed gas into the corresponding cylinder 24. The ECU 20 controls the opening degree of the throttle valve and an injection amount of fuel injected from the fuel injector to adjust an air-fuel ratio.

The forward-reverse switching mechanism 19 includes a drive gear 27, a forward drive gear 28, a reverse drive gear 29, a dog clutch 30, and a shift mechanism 31. The drive gear 27, the forward drive gear 28, and the reverse drive gear 29 are, for example, cylindrical bevel gears. The drive gear 27 is disposed so that a central axis extends vertically. A teeth portion of the drive gear 27 is directed downward. The drive gear 27 is coupled to the lower end portion of the driveshaft 16. Also, each of the forward drive gear 28 and the reverse drive gear 29 is disposed so that its central axis extends to the front and rear. The forward drive gear 28 and the reverse drive gear 29 are disposed so that teeth portions of each oppose each other across an interval in a front/rear direction. The forward drive gear 28 and the reverse drive gear 29 are engaged to the drive gear 27. Each of the forward drive gear 28 and the reverse drive gear 29 surrounds a front end portion of the propeller shaft 17. When a rotation of the drive gear 27 is transmitted to the forward drive gear 28 and the reverse drive gear 29, the forward drive gear 28 and the reverse drive gear 29 rotate in mutually opposite directions.

The dog clutch 30 is disposed between the forward drive gear 28 and the reverse drive gear 29. The dog clutch 30 is, for example, cylindrical. The dog clutch 30 surrounds the front end portion of the propeller shaft 17. The dog clutch 30 is coupled to the front end portion of the propeller shaft 17, for example, by a spline engagement. The dog clutch 30 rotates together with the front end portion of the propeller shaft 17. The dog clutch 30 is movable in an axial direction with respect to the front end portion of the propeller shaft 17. The dog clutch 30 is moved in the axial direction of the propeller shaft 17 by a shift mechanism 31. The shift mechanism 31 includes, for example, a vertically-extending shift rod 32, a shift actuator 33 coupled to an upper end portion of the shift rod 32, and a shift position detecting device 34 arranged to detect a shift position of the dog clutch 30. The dog clutch 30 is moved in the axial direction of the propeller shaft 17 by the shift rod 32 being pivoted by the shift actuator 33.

The shift mechanism 31 positions the dog clutch 30 at a shift position among a forward drive position, a reverse drive position, and a neutral position. The forward drive position is a position at which the dog clutch 30 is engaged with the forward drive gear 28, and the reverse drive position is a position at which the dog clutch 30 is engaged with the reverse drive gear 29. Also, the neutral position is a position at which the dog clutch 30 is engaged with neither the forward drive gear 28 nor the reverse drive gear 29. In the state in which the dog clutch 30 is positioned at the forward drive position, a rotation of the driveshaft 16 is transmitted to the propeller shaft 17 via the forward drive gear 28. Also, in the state in which the dog clutch 30 is positioned at the reverse drive position, the rotation of the driveshaft 16 is transmitted to the propeller shaft 17 via the reverse drive gear 29. Also, in the state in which the dog clutch 30 is positioned at the neutral position, the rotation of the driveshaft 16 is not transmitted to the propeller shaft 17.

The rotation of the engine 15 is transmitted to the driveshaft 16. In the state in which the dog clutch 30 is positioned at the forward drive position or the reverse drive position, the rotation transmitted to the driveshaft 16 is transmitted to the propeller shaft 17 by the forward-reverse switching mechanism 19. The propeller shaft 17 and the propeller 18 are thereby rotated. In the state in which the dog clutch 30 is positioned at the forward drive position, the propeller 18 rotates in the forward drive direction. A forward driving force that propels the hull 3 forward is thereby generated. Also, in the state in which the dog clutch 30 is positioned at the reverse drive position, the propeller 18 rotates in the reverse drive direction that is opposite to the forward drive direction. A reverse driving force that propels the hull 3 in reverse is thereby generated. The rotation direction of the propeller 18 is thus switched by the dog clutch 30 being moved from the forward drive position to the reverse drive position or from the reverse drive position to the forward drive position. The rotation direction of the propeller 18 is switched by the controller lever 5, provided on the hull 3, being operated.

Figure 3:
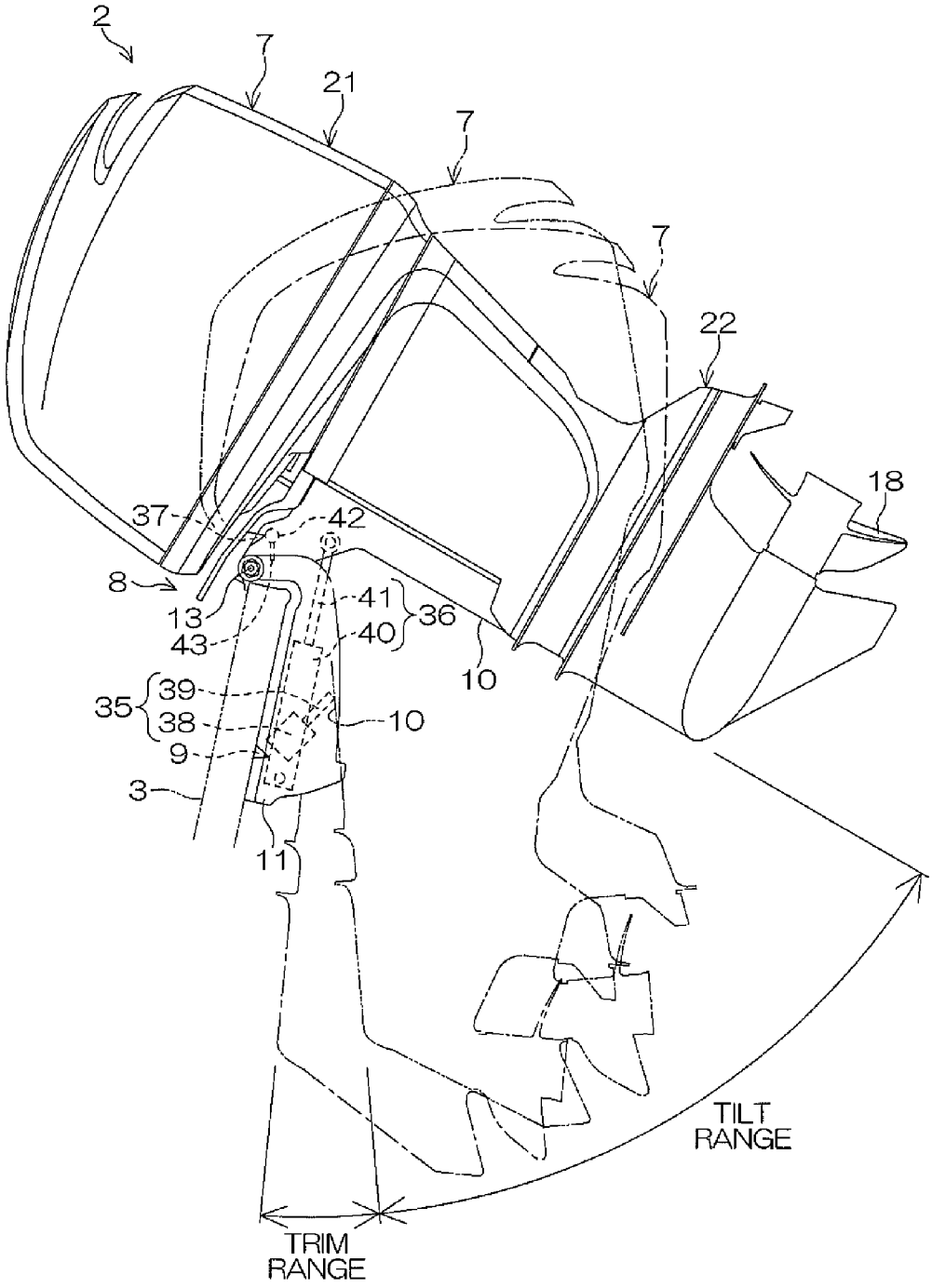
FIG. 3 is a side view of a state in which an outboard motor main body according to a preferred embodiment of the present invention is tilted up.
Figure 4:
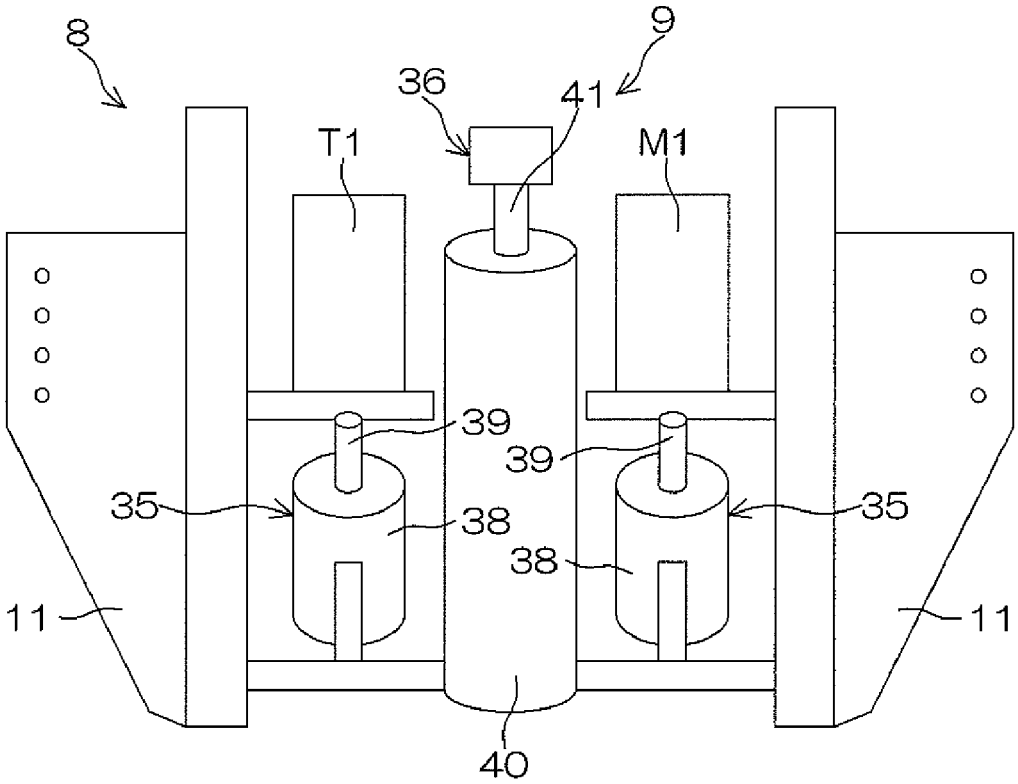
FIG. 4 is a schematic view of an attachment mechanism according to a preferred embodiment of the present invention.

FIG. 3 is a side view of a state in which the outboard motor main body 7 according to a preferred embodiment of the present invention is tilted up (a state in which an inclination angle is within a tilt range). FIG. 4 is a schematic view of the attachment mechanism 8 according to a preferred embodiment of the present invention and shows a state in which a portion of the attachment mechanism 8 is viewed from the rear. An arrangement of the PTT mechanism 9 shall now be described with reference to FIG. 2 to FIG. 4.

The outboard motor main body 7 is pivoted about the tilt shaft 13 between a substantially vertical orientation and an orientation in which a front surface of the outboard motor main body 7 (front surfaces of the engine cover 21 and the casing 22) is inclined greatly and facing downward. If the inclination angle of the outboard motor main body 7 when a lower end of the driveshaft 16 is positioned most closely to the hull 3 is defined as zero, a trim range is a range in which the inclination angle of the outboard motor main body 7 is small, and the tilt range is a range in which the inclination angle of the outboard motor main body 7 is greater than an upper limit value of the trim range. In FIG. 3, a state in which the inclination angle of the outboard motor main body 7 is at a lower limit value of the trim range (full trim-in state) is indicated by alternate long and short dashed lines, and a state in which the inclination angle of the outboard motor main body 7 is at the upper limit value of the trim range (full trim-out state) is indicated by alternate long and two short dashed lines. Also, in FIG. 3, the state in which the inclination angle of the outboard motor main body 7 is at an upper limit value of the tilt range (full tilt-up state) is indicated by solid lines. The upper limit value of the tilt range is, for example, the maximum value of the inclination angle of the outboard motor main body 7. The outboard motor main body 7 can be held at any position within the tilt range.

As shown in FIG. 4, the PTT mechanism 9 includes, for example, two trim cylinders 35 and a tilt cylinder 36. Also, as shown in FIG. 3, the PTT mechanism 9 includes an angle detecting device 37. The respective trim cylinders 35, the tilt cylinder 36, and the angle detecting device 37 are disposed between the two clamp brackets 11. The two trim cylinders 35 are positioned so as to mutually overlap when viewed from the right/left direction of the hull 1. The two trim cylinders 35 are disposed at the respective right and left sides of the tilt cylinder 36. Each trim cylinder 35 is disposed obliquely along the front/rear direction of the marine vessel 1 so that an upper end of the trim cylinder 35 is positioned to the rear relative to a lower end of the trim cylinder 35. Likewise, the tilt cylinder 36 is disposed obliquely along the front/rear direction of the marine vessel 1 so that an upper end of the tilt cylinder 36 is positioned to the rear relative to a lower end of the tilt cylinder 36. The respective trim cylinders 35 and the tilt cylinder 36 are respectively, for example, hydraulic cylinders. As shown in FIG. 4, a tank T1 storing hydraulic oil and a motor M1 that supplies the hydraulic oil are disposed between the two clamp brackets 11. The outboard motor main body 7 and the swivel bracket 10 are pivoted about the tilt shaft 13 by the respective trim cylinders 35 and the tilt cylinder 36.

Each trim cylinder 35 includes a main body 38 and a trim rod 39. Each main body 38 is coupled to the corresponding clamp bracket 11. Each trim rod 39 protrudes obliquely upward toward the rear from an upper end portion of the main body 38. Each trim rod 39 is moved reciprocatingly in an axial direction of the trim rod 39 by a hydraulic force in the main body 38. As indicated by the alternate long and two short dashed lines in FIG. 3, in the state in which the inclination angle of the outboard motor main body 7 is in the trim range, upper end portions of the respective trim rods 39 contact the swivel bracket 10. Thus, in this state, the outboard motor main body 7 is supported from the front side by the two trim rods 39 via the swivel bracket 10. When the inclination angle of the outboard motor main body 7 increases and reaches the tilt range, the upper end portions of the respective trim rods 39 separate from the swivel bracket 10 as indicated by the solid lines in FIG. 3. Supporting of the outboard motor main body 7 by the two trim rods 39 is thus released.

The tilt cylinder 36 includes a main body 40 and a tilt rod 41. A lower end portion of the main body 40 is coupled to the respective clamp brackets 11. The tilt rod 41 protrudes obliquely upward toward the rear from an upper end portion of the main body 40. An upper end portion of the tilt rod 41 is coupled to the swivel bracket 10. The tilt rod 41 is moved reciprocatingly in an axial direction of the tilt rod 41 by the hydraulic force in the main body 40. The upper end portion of the tilt rod 41 is coupled to the swivel bracket 10 in the state in which the inclination angle of the outboard motor main body 7 is in either of the trim range and the tilt range. The outboard motor main body 7 is thus supported by the tilt cylinder 36 in the state in which the inclination angle of the outboard motor main body 7 is in either of the trim range and the tilt range.

In a state in which the inclination angle of the outboard motor main body 7 is in the trim range, the outboard motor main body 7 is supported by the two trim cylinders 35 and the single tilt cylinder 36. Also, in this state, the outboard motor main body 7 is pivoted up and down about the tilt shaft 13 by the two trim cylinders 35 and the single tilt cylinder 36. The inclination angle of the outboard motor main body 7 increases with the increases of protrusion amounts of the respective trim rods 39 and the tilt rod 41. Also, when the inclination angle of the outboard motor main body 7 increases and reaches the tilt range, the supporting of the outboard motor main body 7 by the two trim cylinders 35 is released and the outboard motor main body 7 is supported by the single tilt cylinder 36. In this state, the outboard motor main body 7 is pivoted up and down about the tilt shaft 13 by the single tilt cylinder 36. The inclination angle of the outboard motor main body 7 increases with an increase in the protrusion amount of the tilt rod 41.

The angle detecting device 37 includes, for example, a main body 42 and a lever 43. The main body 42 is held by the swivel bracket 10. The lever 43 protrudes forward from the main body 42 in the state in which the driveshaft 16 of the outboard motor main body 7 is in a substantially vertical direction. The lever 43 is arranged to be pivotable with respect to the main body 42 about a horizontal axis passing through the main body 42. A front end portion of the lever 43 is coupled to the clamp bracket 11. When the outboard motor main body 7 and the swivel bracket 10 are pivoted about the tilt shaft 13, the main body 42 is pivoted about the tilt shaft 13 with the front end portion of the lever 43 being coupled to the clamp bracket 11. The lever 43 is thereby pivoted about the horizontal axis with respect to the main body 42 and is positioned at a pivot angle that is proportional to the inclination angle of the outboard motor main body 7.

The angle detecting device 37 includes, for example, a potentiometer. A voltage is applied to the angle detecting device 37. The angle detecting device 37 outputs, for example, a voltage that is directly proportional to the inclination angle of the outboard motor main body 7 as an angle detection value to the ECU 20. The angle detection value (voltage) input from the angle detecting device 37 into the ECU 20 thus increases with the increase in the inclination angle of the outboard motor main body 7. The angle detection value corresponding to the inclination angle of the outboard motor main body 7 is thereby input into the ECU 20. Also, when a fault (for example, a short circuit or disconnection) occurs in the angle detecting device 37, an angle detection value (abnormal detection value) that is smaller than or larger than a value that is input when the angle detecting device 37 is normal is input into the ECU 20.

More specifically, the angle detection value (voltage) that is input into the ECU 20 when the angle detecting device 37 is normal is, for example, greater than 0V and less than 5V (drive voltage). However, when the angle detecting device 37 becomes disconnected, 0V is input into the ECU 20 in a case of a pull-down arrangement and 5V is input into the ECU 20 in a case of a pull-up arrangement (the present preferred embodiment). "Pull-down" refers to connection to a ground side upon occurrence of a disconnection. "Pull-up" refers to connection to a power supply line side upon occurrence of a disconnection. Also, when short-circuiting of the angle detecting device 37 occurs, a voltage that is in accordance with the component to which the angle detecting device 37 is short-circuited is input into the ECU 20. That is, 0V is input into the ECU 20 when short-circuiting to the ground occurs, 5V is input when short-circuiting to a line to which a voltage of 5V is applied occurs, and 12V (power supply voltage) is input when short-circuiting to a power supply occurs. Thus, when a fault occurs in the angle detecting device 37, an angle detection value that is less or an angle detection value that is greater than the value input when the angle detecting device 37 is normal is input into the ECU 20. The ECU 20 can thus detect the abnormality of the angle detecting device 37 based on the angle detection value input from the angle detecting device 37.

Figure 5:
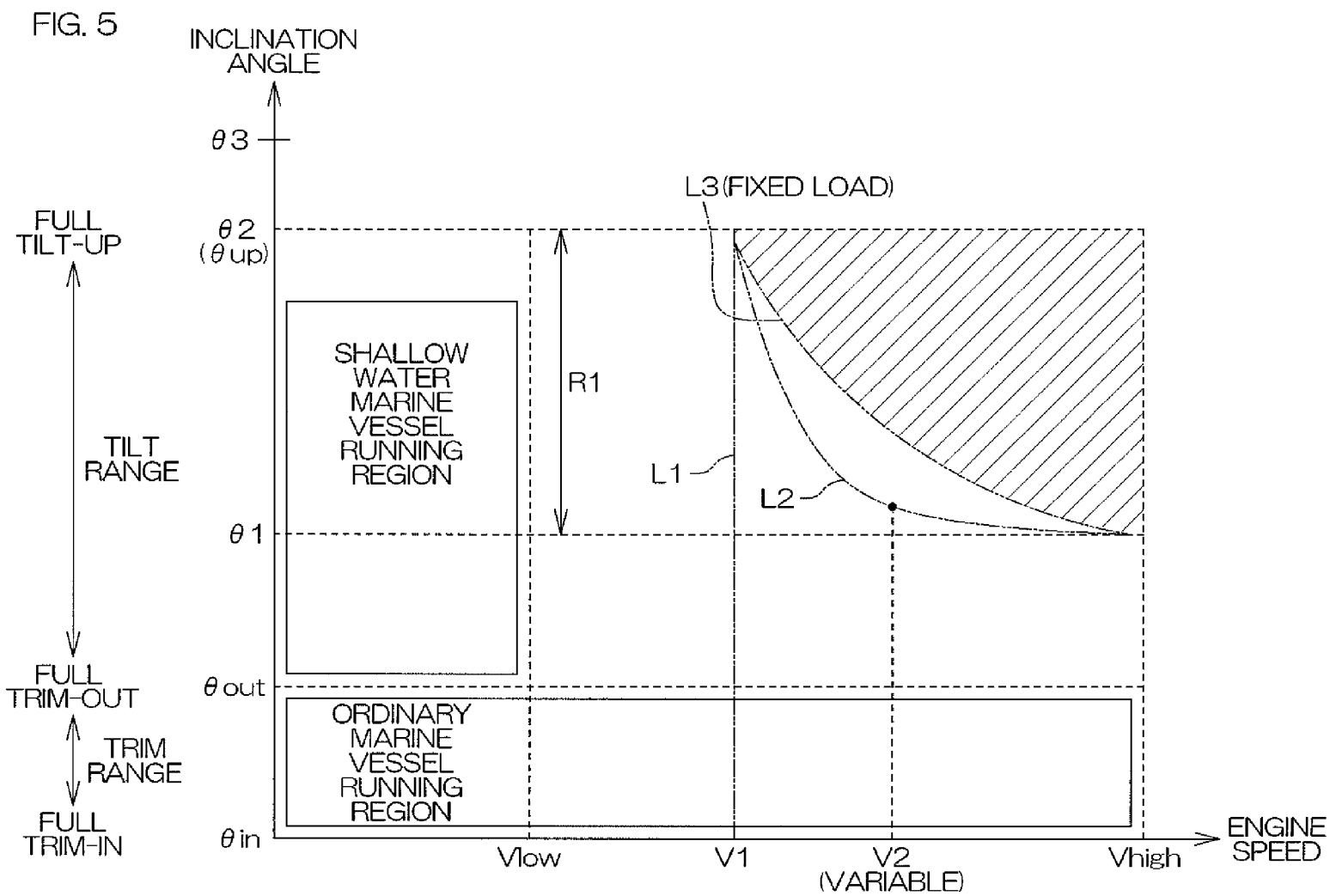
FIG. 5 is a graph for explaining relationships of respective marine vessel running regions with respect to an inclination angle of the outboard motor main body and an engine speed.

FIG. 5 is a graph for explaining relationships of respective marine vessel running regions with respect to the inclination angle of the outboard motor main body 7 and the engine speed of the engine 15. On an ordinate of FIG. 5, "Full trim-in" indicates the state in which the inclination angle of the outboard motor main body 7 is at the lower limit value (full trim-in angle θin) of the trim range, and "Full trim-out" indicates the state in which the inclination angle of the outboard motor main body 7 is at the upper limit value (full trim-out angle θout) of the trim range. The lower limit value of the trim range is, for example, the minimum value of the inclination angle of the outboard motor main body 7. Also, on the ordinate of FIG. 5, "Full tilt-up" indicates the state in which the inclination angle of the outboard motor main body 7 is at the upper limit value (full tilt-up angle θup) of the tilt range. The upper limit value of the tilt range is, for example, the maximum value of the inclination angle of the outboard motor main body 7. The inclination angle of the outboard motor main body 7 indicated by the alternate long and short dashed lines in FIG. 3 corresponds to the "Full trim-in" state, the inclination angle of the outboard motor main body 7 indicated by the alternate long and two short dashed lines in FIG. 3 corresponds to the "Full trim-out" state, and the inclination angle of the outboard motor main body 7 indicated by the solid lines in FIG. 3 corresponds to the "Full tilt-up" state. The relationships of the respective marine vessel running regions with respect to the inclination angle of the outboard motor main body 7 and the engine speed of the engine 15 shall now be described with reference to FIG. 2, FIG. 3, and FIG. 5.

During ordinary marine vessel running (which excludes a state in which the marine vessel 1 is undergoing low-speed forward drive and a state in which the marine vessel 1 is undergoing reverse drive), the inclination angle of the outboard motor main body 7 is set to a value within the trim range by a marine vessel operator. Also, as shown in FIG. 5, during ordinary marine vessel running, the ECU 20 controls the engine speed of the engine 15 to be not more than a high engine speed Vhigh. A region in which the inclination angle of the outboard motor main body 7 is in the trim range and the engine speed of the engine 15 is not more than the high engine speed Vhigh is defined as an ordinary marine vessel running region that is used during ordinary marine vessel running. As shown in FIG. 2, when the inclination angle of the outboard motor main body 7 is in the trim range, the outboard motor main body 7 is supported by the two trim cylinders 35 and the single tilt cylinder 36. Thus, in a state in which the hull 3 is propelled forward in the ordinary marine vessel running region (a state in which the propeller 18 is disposed underwater), the forward driving force that propels the hull 3 forward is transmitted to the hull 3 via the two trim cylinders 35 and the single tilt cylinder 36.

During shallow water marine vessel running, in which the marine vessel 1 is driven forward at a low speed, the inclination angle of the outboard motor main body 7 is set inside the tilt range by the marine vessel operator. Also, as shown in FIG. 5, during shallow water marine vessel running, the engine speed of the engine 15 is set to not more than a low engine speed Vlow by the marine vessel operator. A region in which the inclination angle of the outboard motor main body 7 is in the tilt range and the engine speed of the engine 15 is not more than the low rotation speed Vlow is defined as a shallow water marine vessel running region that is used during shallow water marine vessel running. As shown in FIG. 3, in the state in which the inclination angle of the outboard motor main body 7 is in the tilt range, the supporting of the outboard motor main body 7 by the two trim rods 39 is released and the outboard motor main body 7 is supported by the single tilt cylinder 36. Thus, in a state in which the hull 3 is propelled forward in the shallow water marine vessel running region (state in which the propeller 18 is disposed underwater), the forward driving force that propels the hull 3 forward is transmitted to the hull 3 via the single tilt cylinder 36.

In a state in which the outboard motor main body 7 is tilted up, the outboard motor main body 7 is supported by only the single tilt cylinder 36. Thus, in this state, a load applied to the tilt rod 41 is greater than that in the state in which the inclination angle of the outboard motor main body 7 is in the trim range. Also, in the state in which the outboard motor main body 7 is tilted up, the inclination angle of the outboard motor main body 7 increases with an increase in the protrusion amount of the tilt rod 41. When the protrusion amount of the tilt rod 41 increases, the load applied to the tilt rod 41 increases. Also, the forward driving force that propels the hull 3 forward increases with an increase in the engine speed of the engine 15. When the forward driving force increases, the load applied to the tilt rod 41 increases. The load applied to the tilt rod 41 thus increases with the increase in the inclination angle of the outboard motor main body 7 and the increase in the engine speed of the engine 15.

A load reference line L3 shown in FIG. 5 is a line obtained from measured values of the inclination angle of the outboard motor main body 7 and the engine speed of the engine 15 when a load of a fixed magnitude (a fixed load) is applied from the outboard motor main body 7 to the PTT mechanism 9. The "fixed load" is, for example, a minimum value of a load at which at least one component among the attachment mechanism 8, the PTT mechanism 9, and the hull 3 breaks. Deformation of the clamp bracket 11, the swivel bracket 10, or the tilt shaft 13 is an example of breakage of the attachment mechanism 8. Deformation of the tilt rod 41 or damaging of the main body 40 of the tilt cylinder 36 is an example of breakage of the PTT mechanism 9. Deformation or breakage of the rear portion (transom) of the hull 3 is an example of breakage of the hull 3. In the present preferred embodiment, the "fixed load" is, for example, the minimum value of the load at which the tilt rod 41 bends.

As shown in FIG. 5, the load reference line L3 is, for example, a curve. A hatched region in FIG. 5 is a region in which the load applied to the tilt rod 41 exceeds the fixed load. The ECU 20 reduces the engine speed of the engine 15 so that the load applied to the tilt rod 41 is less than the fixed load. Specifically, when the inclination angle of the outboard motor main body 7 is in a predetermined angular range R1 and the engine speed of the engine 15 exceeds a speed threshold (speed threshold V1 or V2), the ECU 20 reduces the engine speed of the engine 15 so that the engine speed of the engine 15 is not more than the speed threshold. Also, even in the state in which the inclination angle of the outboard motor main body 7 is within either of the trim range or the tilt range, if the engine speed of the engine 15 exceeds the high engine speed Vhigh, the ECU 20 reduces the engine speed of the engine 15 so that the engine speed of the engine 15 is not more than the high engine speed Vhigh.

As shown in FIG. 5, a lower limit value (lower limit angle θ1) of the predetermined angular range R1 is an angle that is greater than the full trim-out angle θout. The lower limit angle θ1 is thus an angle at which the outboard motor main body 7 is supported only by the tilt cylinder 36. Also, an upper limit value (upper limit angle θ2) of the predetermined angular range R1 is, for example, an angle equal to the full tilt-up angle θup (maximum value of the inclination angle of the outboard motor main body 7). As mentioned above, when a fault (short-circuiting or disconnection) of the angle detecting device 37 occurs, the abnormal detection value is input from the angle detecting device 37 into the ECU 20. The abnormal detection value is, for example, the angle detection value corresponding to an abnormal angle θ3. The abnormal angle θ3 is greater than the upper limit angle θ2.

The speed threshold is an engine speed of the engine 15 that is determined from a speed reference line L1 or a speed reference line L2 shown in FIG. 5. Each of the speed reference line L1 and the speed reference line L2 is a line that is obtained from the inclination angle of the outboard motor main body 7 and the engine speed of the engine 15 when the load applied to the tilt rod 41 is less than the fixed load. The speed reference line L1 is a straight line parallel to the ordinate. The speed reference line L1 is, for example, close to the load reference line L3 at the full tilt-up angle θup. In a case in which the speed threshold is determined from the speed reference line L1, the speed threshold is a fixed speed threshold V1 (constant) regardless of the inclination angle of the outboard motor main body 7.

Meanwhile, the speed reference line L2 is a line with which the engine speed of the engine 15 varies according to the inclination angle of the outboard motor main body 7. The speed reference line L2 is, for example, a curve that varies in a manner similar to the load reference line L3. The speed reference line L2 is, for example, close to the load reference line L3 and the speed reference line L1 at the full tilt-up angle θup and is close to the load reference line L3 at the lower limit angle θ1. At any inclination angle, a shortest distance from the load reference line L3 to the speed reference line L2 is not more than a distance from the load reference line L3 to the speed reference line L1. In a case in which the speed threshold is determined from the speed reference line L2, the speed threshold is a speed threshold V2 (variable) that varies according to the inclination angle of the outboard motor main body 7. A "first speed value" according to a preferred embodiment of the present invention preferably is, for example, a speed detection value corresponding to the speed threshold V1 or the speed threshold V2.

Figure 6:
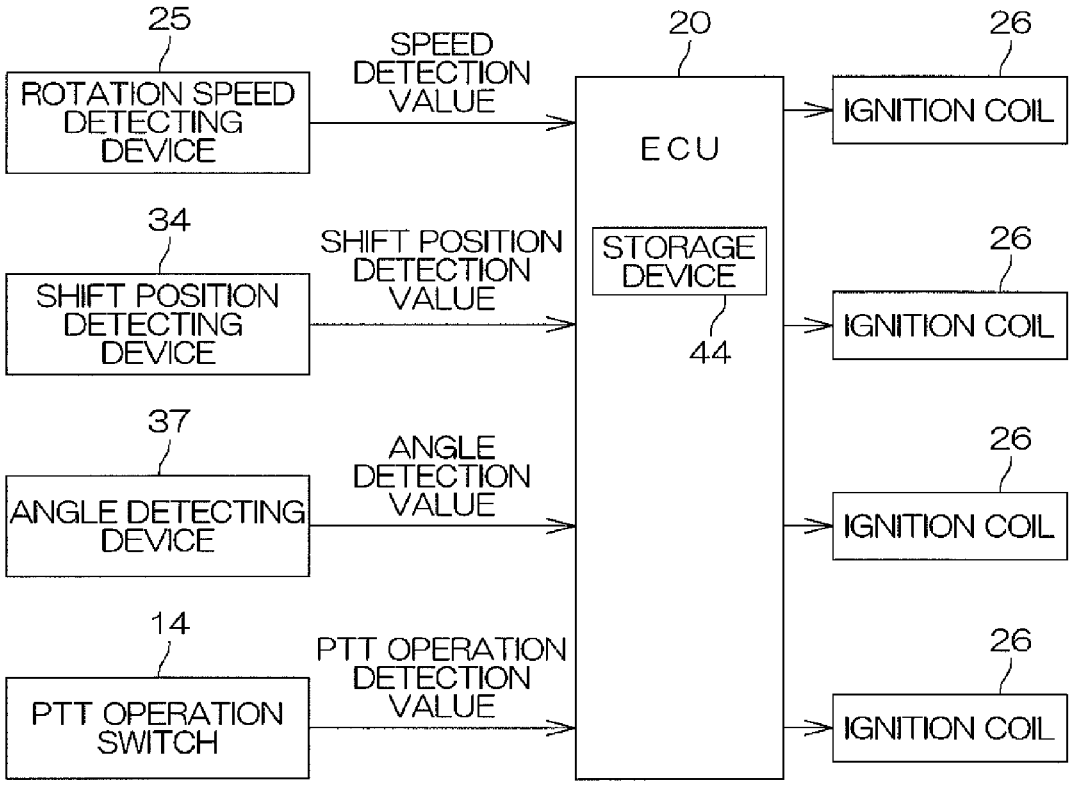
FIG. 6 is a block diagram for explaining an electrical arrangement of the outboard motor according to a preferred embodiment of the present invention.

FIG. 6 is a block diagram for explaining an electrical arrangement of the outboard motor 2 according to a preferred embodiment of the present invention.

The ECU 20 includes a storage device 44. The storage device 44 is, for example, a non-volatile memory that holds stored contents even when power is not supplied. A control program for controlling the outboard motor 2 and control information of the outboard motor 2 are stored in the storage device 44. The ECU 20 controls the outboard motor 2 in accordance with the control program stored in the storage device 44.

The speed detection value, the shift position detection value, and the angle detection value are input into the ECU 20 from the rotation speed detecting device 25, the shift position detecting device 34, and the angle detecting device 37, respectively. The ECU 20 computes the engine speed of the engine 15, the shift position of the dog clutch 30, and the inclination angle of the outboard motor main body 7 from the input speed detection value, shift position detection value, and angle detection value, respectively. Also, when the PTT operation switch 14 is operated, a PTT operation detection value is input into the ECU 20.

As shall be described below, the ECU 20 reduces the engine speed of the engine 15 based on the engine speed of the engine 15, the shift position of the dog clutch 30, the inclination angle of the outboard motor main body 7, etc. That is, the ECU 20 controls the four ignition coils 26 to stop ignition of at least one of the four spark plugs. At least one of the four cylinders 24 thus misfires and the engine speed of the engine 15 is reduced. The rotation speed of the propeller 18 thus decreases and the propulsive force decreases.

Figure 7:
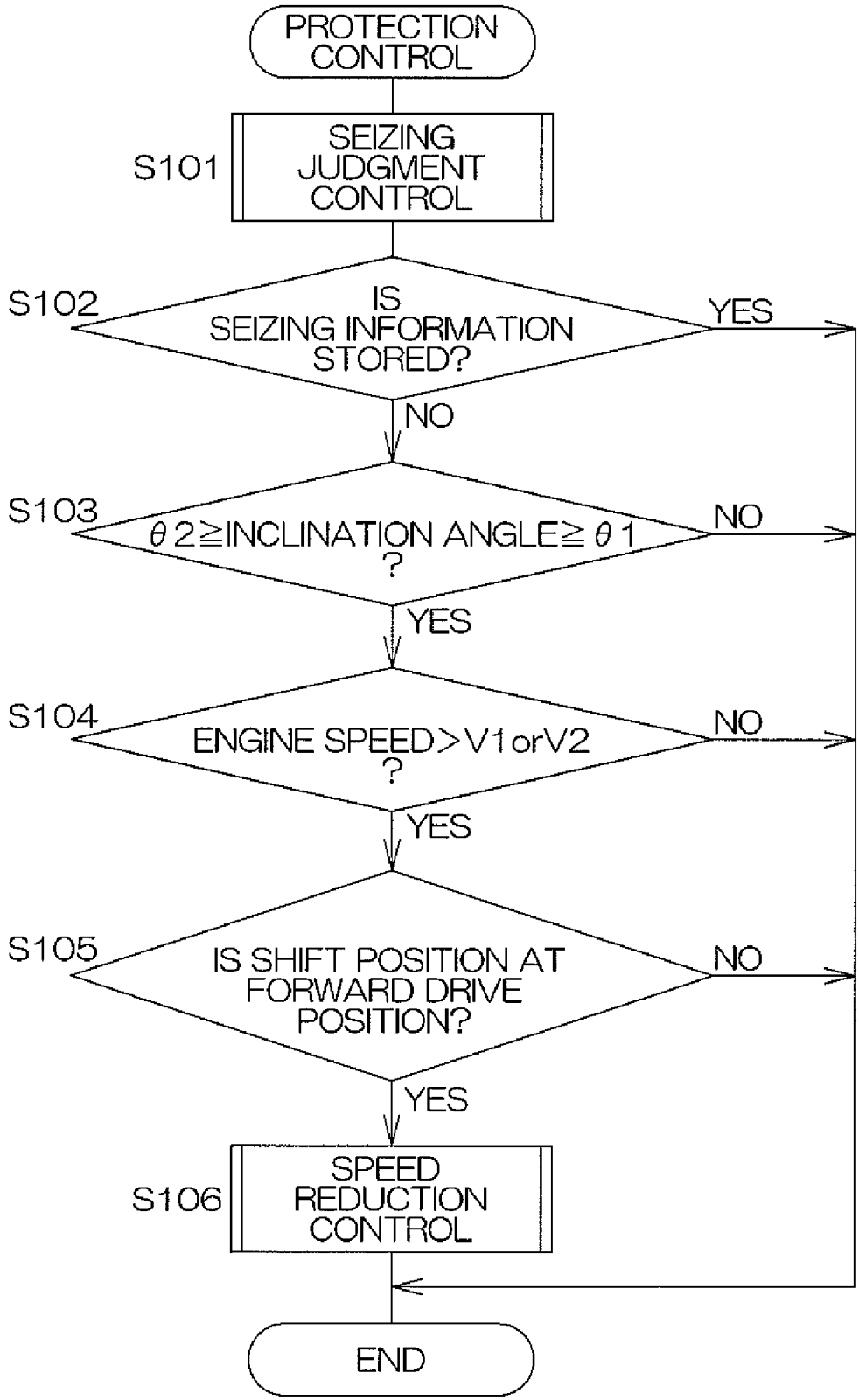
FIG. 7 is a flowchart for describing a protection control according to a preferred embodiment of the present invention.
Figure 8:
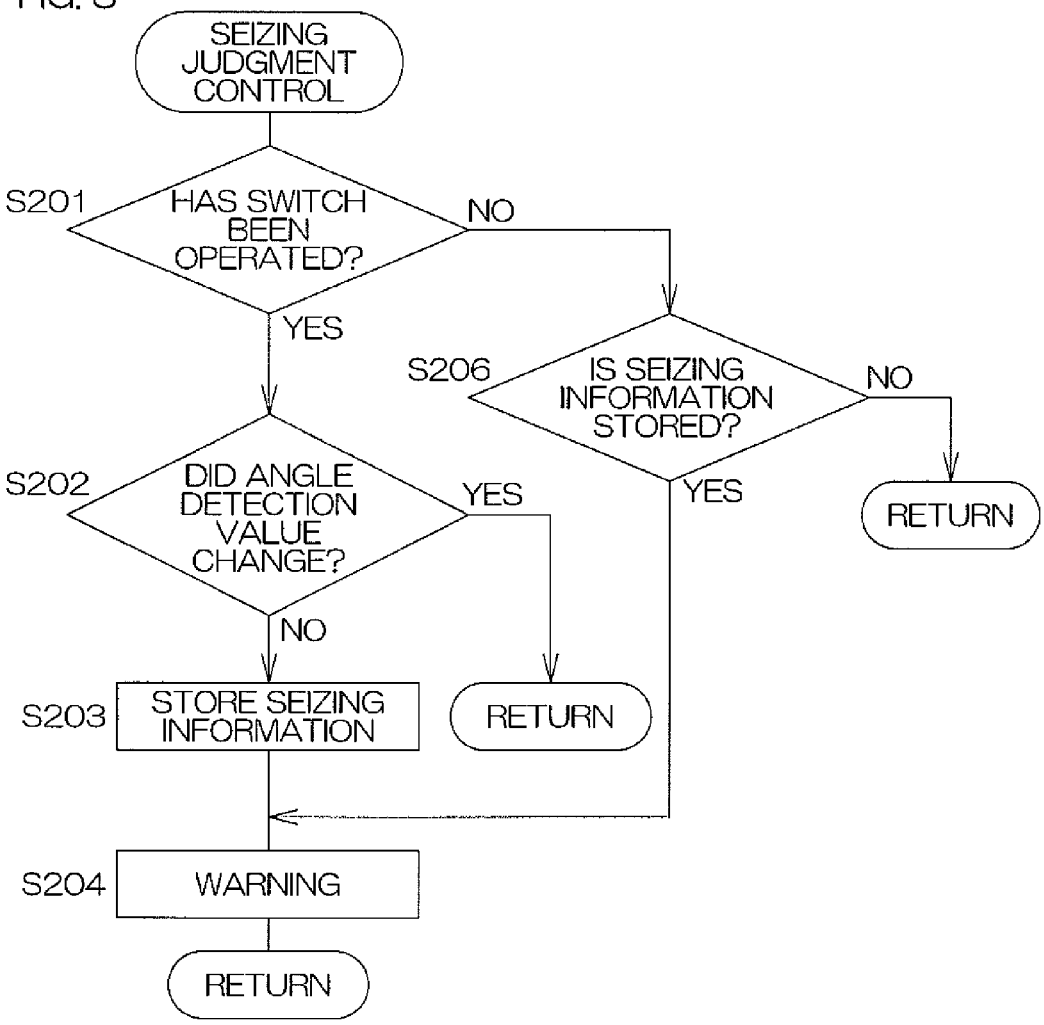
FIG. 8 is a flowchart for explaining a seizing judgment control according to a preferred embodiment of the present invention.

FIG. 7 is a flowchart for describing a protection control according to a preferred embodiment of the present invention. FIG. 8 is a flowchart for explaining a seizing judgment control according to a preferred embodiment of the present invention. The protection control to protect the tilt rod 41 shall now be described with reference to FIG. 2, FIG. 7, and FIG. 8. FIG. 1 and FIG. 5 shall also be referenced as necessary in the following description.

As shown in FIG. 7, the ECU 20 first performs the seizing judgment control of judging whether or not the lever 43 of the angle detecting device 37 is seized (S101). As shown in FIG. 8, in the seizing judgment control, the ECU 20 judges whether or not the PTT operation switch 14 (see FIG. 1) has been operated (S201). That is, whether or not the PTT mechanism 9 has pivoted the outboard motor main body 7 about the tilt shaft 13 is judged. If the PTT operation switch 14 has been operated (in the case of Yes at S201), the ECU 20 compares the angle detection value input from the angle detecting device 37 before the PTT mechanism 9 pivoted the outboard motor main body 7 and the angle detection value input from the angle detecting device 37 after the PTT mechanism 9 pivoted the outboard motor main body 7. The ECU 20 thereby judges whether or not the angle detection value has changed before and after the PTT mechanism 9 pivoted the outboard motor main body 7 (S202).

If the PTT operation switch 14 has been operated (in the case of Yes at S201), the actual inclination angle of the outboard motor main body 7 is changed. Thus, if the angle detection value has not changed before and after the operation of the PTT operation switch 14 (in the case of No at S202), the lever 43 of the angle detecting device 37 may be seized. That is, the lever 43 does not pivot with respect to the main body 42 and an angle detection value that differs from the angle detection value corresponding to the actual inclination angle of the outboard motor main body 7 may be input into the ECU 20. Thus, in this case (in the case of No at S202), the ECU 20 stores the seizing information of the lever 43 in the storage device 44 (S203) and warns the marine vessel operator, for example, by a display on the display portion 6 (see FIG. 1) (S204). The ECU 20 then ends the seizing judgment control (proceeds to S102). Likewise, the ECU 20 also ends the seizing judgment control (proceeds to S102) if the angle detection value has changed before and after the PTT operation switch 14 is operated (in the case of Yes in S202).

On the other hand, if the PTT operation switch 14 has not been operated (in the case of No at S201), the ECU 20 checks whether or not seizing information of the lever 43 is stored in the storage device 44 (S206). If the seizing information of the lever 43 is not stored in the storage device 44 (in the case of No at S206), the ECU 20 ends the seizing judgment control (proceeds to S102). Also, if the seizing information of the lever 43 is stored in the storage device 44 (in the case of Yes at S206), the ECU 20 warns the marine vessel operator (S204). The ECU 20 then ends the seizing judgment control (proceeds to S102).

After the seizing judgment control has been executed, the ECU 20 checks whether or not seizing information of the lever 43 is stored in the storage device 44 (S102) as shown in FIG. 7. If the seizing information is stored (in the case of Yes at S102), the ECU 20 ends the protection control. Also, if the seizing information is not stored (in the case of No at S102), the ECU 20 judges whether or not the inclination angle of the outboard motor main body 7 is within the predetermined angular range R1 (not less than the lower limit angle θ1 and not more than the upper limit angle θ2) (S103). If the inclination angle of the outboard motor main body 7 is not within the predetermined angular range R1 (in the case of No at S103), the ECU 20 ends the protection control. Also, if the inclination angle of the outboard motor main body 7 is within the predetermined angular range R1 (in the case of Yes at S103), the ECU 20 judges whether or not the engine speed of the engine 15 exceeds the speed threshold (the speed threshold V1 or V2) (S104).

As shown in FIG. 5, in the case in which the speed threshold is determined from the speed reference line L1, the speed threshold is the speed threshold V1 (constant). Thus, in this case, the ECU 20 judges whether or not the engine speed of the engine 15 exceeds the speed threshold V1 (S104). If the engine speed of the engine 15 does not exceed the speed threshold V1 (in the case of No at S104), the ECU 20 ends the protection control. Also, if the engine speed of the engine 15 exceeds the speed threshold V1 (in the case of Yes at S104), the ECU 20 judges whether or not the shift position of the dog clutch 30 is the forward drive position (S105).

Meanwhile, as shown in FIG. 5, in the case in which the speed threshold is determined from the speed reference line L2, the speed threshold is the speed threshold V2 (variable) that varies according to the inclination angle of the outboard motor main body 7. Thus, in this case, the ECU 20 determines the speed threshold V2 corresponding to the inclination angle of the outboard motor main body 7 from the speed reference line L2. The ECU 20 then judges whether or not the engine speed of the engine 15 exceeds the determined speed threshold V2 (S104). If the engine speed of the engine 15 does not exceed the speed threshold V2 (in the case of No at S104), the ECU 20 ends the protection control. Also, if the engine speed of the engine 15 exceeds the speed threshold V2 (in the case of Yes at S104), the ECU 20 judges whether or not the shift position of the dog clutch 30 is the forward drive position (S105).

As shown in FIG. 7, if the shift position of the dog clutch 30 is not the forward drive position (in the case of No at S105), the ECU 20 ends the protection control. If the shift position of the dog clutch 30 is the forward drive position (in the case of Yes at S105), the ECU 20 performs a speed reduction control of reducing the engine speed of the engine 15 (S106). That is, in the case in which the inclination angle of the outboard motor main body 7 is within the predetermined angular range R1, the outboard motor main body 7 is supported only by the single tilt cylinder 36. The forward driving force that propels the hull 3 forward thus concentrates via the swivel bracket 10 onto the tilt rod 41, the main body 40 of the tilt cylinder 36 that houses the tilt rod 41, and the tilt shaft 13. The ECU 20 thus reduces the engine speed of the engine 15 by performing the speed reduction control to control the engine 15 so that the load applied to the tilt cylinder 36 is less than the fixed load.

Figure 9:
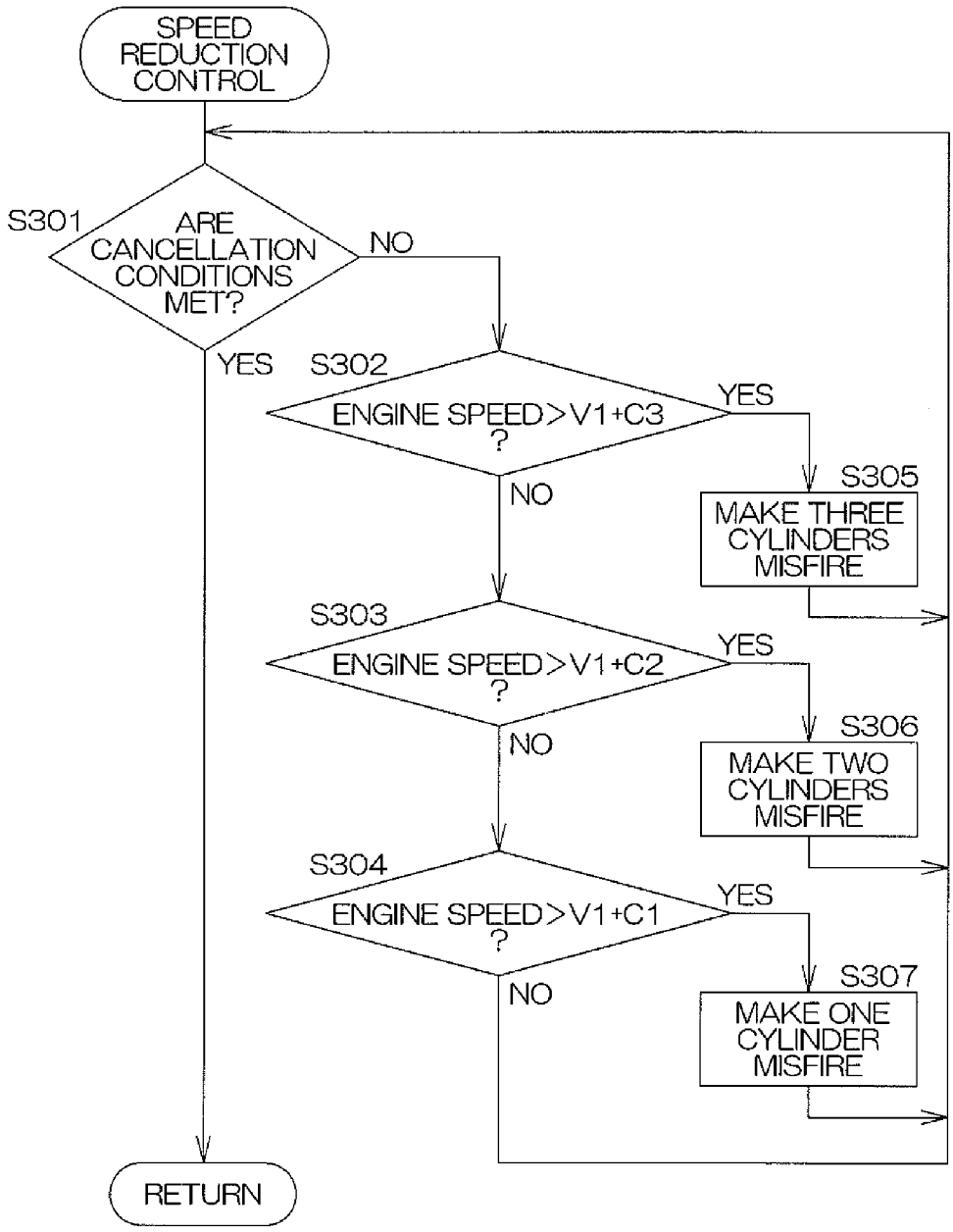
FIG. 9 is a flowchart for explaining a first example of a speed reduction control according to a preferred embodiment of the present invention.

FIG. 9 is a flowchart for explaining a first example of the speed reduction control according to a preferred embodiment of the present invention. The flow shown in FIG. 9 is a flow in the case in which the speed threshold is determined from the speed reference line L1 shown in FIG. 5. In the case in which the speed threshold is determined from the speed reference line L1, the speed threshold is the fixed speed threshold V1 (constant) regardless of the inclination angle of the outboard motor main body 7. The speed reduction control of reducing the engine speed of the engine 15 shall now be described with reference to FIG. 2 and FIG. 9.

As shown in FIG. 9, in the speed reduction control, the ECU 20 judges whether or not cancellation conditions for ending the speed reduction control are met (S301). Specifically, the ECU 20 judges, for example, whether or not the engine speed of the engine 15 is less than the speed threshold V1. Even in the case in which the engine speed of the engine 15 is greater than the speed threshold V1, if, for example, the throttle valve is thereafter closed until the opening degree is substantially zero, the engine speed of the engine 15 decreases even though the engine 15 is not made to misfire. Thus, for example, in the case in which the opening degree of the throttle valve is substantially zero and the engine speed of the engine 15 is less than the speed threshold V1 (in the case of Yes at S301), the ECU 20 ends the speed reduction control without making the engine 15 misfire. On the other hand, if the engine speed of the engine 15 is greater than the speed threshold V1, the ECU 20 judges whether or not to make the engine 15 misfire (S302 to S304).

As shown in FIG. 9, in judging whether or not to make the engine 15 misfire, the ECU 20, for example, judges whether or not the engine speed of the engine 15 is greater than a sum of the speed threshold V1 and a constant C3 (constant C3>0) (S302). If the engine speed of the engine 15 is not more than the sum of the speed threshold V1 and the constant C3 (in the case of No at S302), the ECU 20 judges whether or not the engine speed of the engine 15 is greater than a sum of the speed threshold V1 and a constant C2 (constant C3>constant C2) (S303). If the engine speed of the engine 15 is not more than the sum of the speed threshold V1 and the constant C2 (in the case of No at S303), the ECU 20 judges whether or not the engine speed of the engine 15 is greater than a sum of the speed threshold V1 and a constant C1 (constant C2>constant C1≧0) (S304).

As shown in FIG. 9, if the engine speed of the engine 15 exceeds speed threshold V1+constant C3 (in the case of Yes at S302), the ECU 20 controls the four ignition coils 26 to make three of the cylinders 24 misfire (S305). Also, if the engine speed of the engine 15 exceeds speed threshold V1+constant C2 (in the case of Yes at S303), the ECU 20 makes two of the cylinders 24 misfire (S306). Also, if the engine speed of the engine 15 exceeds speed threshold V1+constant C1 (in the case of Yes at S304), the ECU 20 makes one of the cylinders 24 misfire (S307). The ECU 20 thereby reduces the engine speed of the engine 15 to a fixed value less than the speed threshold V1 (for example, a value slightly less than the speed threshold V1). After reducing the engine speed of the engine 15, the ECU 20 judges again whether or not the cancellation conditions for ending the speed reduction control are met (returns to S301). Also, if in S304, the engine speed of the engine 15 is not more than speed threshold V1+constant C1 (in the case of No), the ECU 20 judges again whether or not the cancellation conditions for ending the speed reduction control are met (returns to S301).

Figure 10:
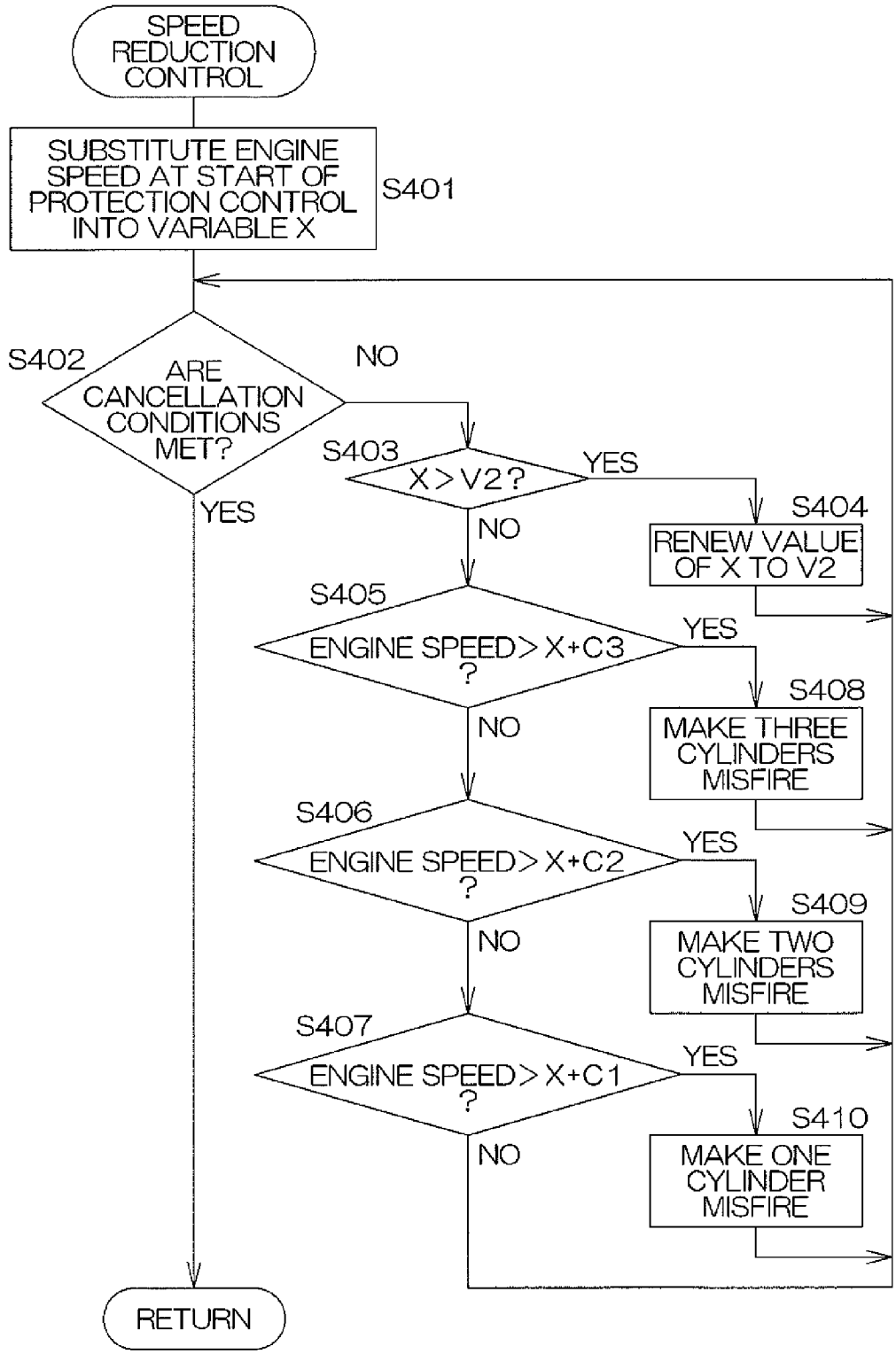
FIG. 10 is a flowchart for explaining a second example of a speed reduction control according to a preferred embodiment of the present invention.

FIG. 10 is a flowchart for explaining a second example of the speed reduction control according to a preferred embodiment of the present invention. The flow shown in FIG. 10 is a flow in the case in which the speed threshold is determined from the speed reference line L2 shown in FIG. 5. In the case in which speed threshold is determined from the speed reference line L2, the speed threshold is the speed threshold V2 (variable) that varies according to the inclination angle of the outboard motor main body 7. The speed reduction control of decreasing the engine speed of the engine 15 shall now be described with reference to FIG. 2 and FIG. 10. FIG. 1 and FIG. 5 shall also be referenced as necessary in the following description.

As shown in FIG. 10, in the speed reduction control, the ECU 20 substitutes the engine speed of the engine 15 at the start of the protection control into a variable X (S401). The ECU 20 then judges whether or not cancellation conditions for ending the speed reduction control are met (S402). Specifically, the ECU 20 judges, for example, whether or not the engine speed of the engine 15 is less than the speed threshold V2. If the cancellation conditions for ending the speed reduction control are met (in the case of Yes at S402), the ECU 20 ends the speed reduction control without making the engine 15 misfire. On the other hand, if the cancellation conditions for ending the speed reduction control are not met (in the case of No at S402), the ECU 20 judges whether or not to make the engine 15 misfire (S405 to S407).

As shown in FIG. 10, in judging whether or not to make the engine 15 misfire, the ECU 20, for example, judges whether or not the variable X is greater than the speed threshold V2 (S403). If the variable X is greater than the speed threshold V2 (in the case of Yes at S403), the ECU 20 renews the value of the variable X to the speed threshold V2 (S404). Thereafter, the ECU 20 judges again whether or not the cancellation conditions for ending the speed reduction control are met (returns to S402). If the cancellation conditions for ending the speed reduction control are not met (in the case of No at S402 for the second time), the ECU 20 judges again whether or not the variable X is greater than the speed threshold V2 (S403 for the second time). If the variable X is greater than the speed threshold V2 this time (in the case of Yes at S403 for the second time), the ECU 20 renews the value of the variable X to the speed threshold V2 again (S404 for the second time).

When judging whether or not the variable X is greater than the speed threshold V2 for the first time (S403), the value of the variable X is the engine speed of the engine 15 at the start of the protection control. If the engine speed of the engine 15 at the start of the protection control is not greater than the speed threshold V2, the speed reduction control is not performed. Thus, if, when judging whether or not the variable X is greater than the speed threshold V2 for the first time (S403), the inclination angle of the outboard motor main body 7 is not decreased, the variable X is greater than the speed threshold V2. That is, as shown in FIG. 5, when the inclination angle of the outboard motor main body 7 decreases, the speed threshold V2 increases. Thus, if the inclination angle of the outboard motor main body 7 is not decreased, the variable X is greater than the speed threshold V2 (Yes at S403). The value of the variable X is thus renewed to the speed threshold V2 (S404).

Also, when, whether or not the variable X is greater than the speed threshold V2 is judged for the second time (S403), the inclination angle of the outboard motor main body 7 is not changed, the variable X is equal to the speed threshold V2. However, if, by the time the second judgment (S403) is made, the inclination angle of the outboard motor main body 7 is increased due, for example, to operation of the PTT operation switch 14 (see FIG. 1) or collision of the outboard motor main body 7 with driftwood, etc., the speed threshold V2 is decreased. Thus, in this case, the value of the variable X is greater than the speed threshold V2 (Yes at S403). Thus, in this case, the value of the variable X is renewed to the speed threshold V2 again (S404). The value of the variable X is thus renewed to a smaller value in accordance with increase in the inclination angle of the outboard motor main body 7.

On the other hand, if, in S403, the variable X is not more than the speed threshold V2 (in the case of No), the ECU 20 judges whether or not the engine speed of the engine 15 is greater than a sum of the variable X and the constant C3 (constant C3>0) (S405) as shown in FIG. 10. If the engine speed of the engine 15 is not more than the sum of the variable X and the constant C3 (in the case of No at S405), the ECU 20 judges whether or not the engine speed of the engine 15 is greater than a sum of the variable X and the constant C2 (constant C3>constant C2) (S406). If the engine speed of the engine 15 is not more than the sum of the variable X and the constant C2 (in the case of No at S406), the ECU 20 judges whether or not the engine speed of the engine 15 is greater than a sum of the variable X and the constant C1 (constant C2>constant C1≧0) (S407).

As shown in FIG. 10, if the engine speed of the engine 15 exceeds variable X+constant C3 (in the case of Yes at S405), the ECU 20 makes three of the cylinders 24 misfire (S408). Also, if the engine speed of the engine 15 exceeds variable X+constant C2 (in the case of Yes at S406), the ECU 20 makes two of the cylinders 24 misfire (S409). Also, if the engine speed of the engine 15 exceeds variable X+constant C1 (in the case of Yes at S407), the ECU 20 makes one of the cylinders 24 misfire (S410). The ECU 20 thereby decreases the engine speed of the engine 15 to a fixed value less than the variable X (for example, a value slightly less than the variable X). After decreasing the engine speed of the engine 15, the ECU 20 judges again whether or not the cancellation conditions for ending the speed reduction control are met (returns to S402). Also, if, in S407, the engine speed of the engine 15 is not more than variable X+constant C1 (in the case of No), the ECU 20 judges again whether or not the cancellation conditions for ending the speed reduction control are met (returns to S402).

As described above, with the present preferred embodiment, the ECU 20 executes the speed reduction control according to the inclination angle of the outboard motor main body 7 and the engine speed of the engine 15 to forcibly reduce the engine speed of the engine 15. Specifically, when the angle detection value input from the angle detecting device 37 into the ECU 20 is a value corresponding to an inclination angle less than the full trim-in angle θin or a value corresponding to an inclination angle greater than the full tilt-up angle θup, the ECU 20 does not execute the speed reduction control. On the other hand, if the angle detection value input from the angle detecting device 37 into the ECU 20 is a value corresponding to an inclination angle not less than the lower limit angle θ1 and not more than the upper limit angle θ2 (θ2=θup) and the engine speed of the engine 15 exceeds the speed threshold (speed threshold V1 or V2), the ECU 20 executes the speed reduction control.

When the inclination angle of the outboard motor main body 7 is not less than the lower limit angle θ1, the supporting of the outboard motor main body 7 by the trim cylinders 35 is released. Thus, a load that is larger than that which is applied when the outboard motor main body 7 is supported by the trim cylinders 35 and the tilt cylinder 36 is applied to the tilt cylinder 36. Also, the propulsive force generated by the outboard motor main body 7 increases with the increase in the engine speed of the engine 15. The load applied to the tilt cylinder 36 thus increases with the increase in the engine speed of the engine 15. Thus, by the ECU 20 reducing the engine speed of the engine 15 when the inclination angle of the outboard motor main body 7 is not less than the lower limit angle θ1, application of a large load to the tilt cylinder 36 is prevented.

Also, the angle detecting device 37 is arranged to output the abnormal detection value corresponding to the abnormal angle θ3 when short-circuiting or other abnormality of the angle detecting device 37 occurs. The ECU 20 reduces the engine speed of the engine 15 to make the load applied to the tilt cylinder 36 less than the fixed load when the inclination angle of the outboard motor main body 7 is not less than the lower limit angle θ1 and not more than the upper limit angle θ2 that is less than the abnormal angle θ3. Thus, when short-circuiting or other abnormality of the angle detecting device 37 occurs, the abnormal detection value corresponding to the abnormal angle θ3 is input from the angle detecting device 37 into the ECU 20 and the ECU 20 thus does not forcibly reduce the engine speed of the engine 15. Thus, for example, the engine speed of the engine 15 can be prevented from being reduced forcibly when the actual inclination angle of the outboard motor main body 7 is within the trim range. Forcible reduction in the propulsive force during ordinary marine vessel running can thereby be prevented.

Also, with the present preferred embodiment, the ECU 20 judges whether or not the angle detection value has changed before and after pivoting of the outboard motor main body 7 by the PTT mechanism 9. If the angle detecting device 37 is operating normally, the angle detection value changes before and after pivoting of the outboard motor main body 7 by the PTT mechanism 9. Thus, by judging whether or not the angle detection value has changed before and after pivoting of the outboard motor main body 7 by the PTT mechanism 9, the ECU 20 can judge whether or not the angle detecting device 37 is operating normally. When the ECU 20 judges that the angle detecting device 37 is not operating normally, the ECU 20 does not forcibly reduce the engine speed of the engine 15. The inclination angle of the outboard motor main body 7 can thus be prevented from being erroneously judged, due to abnormality (for example, seizing) of the angle detecting device 37, to be not less than the lower limit angle θ1 and not more than the upper limit angle θ2 despite the actual inclination angle of the outboard motor main body 7 being within the trim range. Forcible reduction in the propulsive force during ordinary marine vessel running can thereby be prevented.

When, for example, the marine vessel 1 is to be moored, the outboard motor main body 7 is maintained in a state in which it is tilted up. When the outboard motor main body 7 is tilted up, the lever 43 of the angle detecting device 37 is pivoted with respect to the main body 42. Thus, when the marine vessel 1 is moored for a long time, the lever 43 may become seized at the pivoting angle at which the inclination angle of the outboard motor main body 7 is in the tilt range. There thus may be a case in which, even after the PTT mechanism 9 pivots the outboard motor main body 7 so that the inclination angle of the outboard motor main body 7 falls within the trim range, the angle detection value detected when the inclination angle is in the tilt range is input into the ECU 20 and it is judged that the outboard motor main body 7 is tilted up. Thus, by the ECU 20 judging whether or not the angle detecting device 37 is operating normally as in the present preferred embodiment, forcible decreases in the propulsive force during ordinary marine vessel running can be prevented.

Also, with the present preferred embodiment, the outboard motor main body 7 preferably includes the forward-reverse switching mechanism 19. When the dog clutch 30 is positioned at the forward drive position, the forward-reverse switching mechanism 19 switches to the forward drive state in which the outboard motor main body 7 generates the forward driving force that propels the hull 3 forward. Also, when the dog clutch 30 is positioned at the reverse drive position, the forward-reverse switching mechanism 19 switches to the reverse drive state in which the outboard motor main body 7 generates the reverse driving force that propels the hull 3 in reverse. When the forward-reverse switching mechanism 19 is in the forward drive state and the inclination angle of the outboard motor main body 7 is not less than the lower limit angle θ1 and not more than the upper limit angle θ2, the ECU 20 reduces the engine speed of the engine 15 so that the load applied to the tilt cylinder 36 is less than the fixed load. Forcible reduction in the propulsive force (reverse driving force) can thus, prevented during reverse drive of the marine vessel 1. Also, ordinarily, the maximum value of the reverse driving force is less than the maximum value of the forward driving force and thus even when the hull 3 is driven in reverse with the outboard motor main body 7 being tilted up, a large load is not applied to the tilt rod 41.

Also, as was described in regard to the speed reduction control, the ECU 20 decreases the engine speed of the engine 15 when the inclination angle of the outboard motor main body 7 is not less than the lower limit angle θ1 and not more than the upper limit angle θ2 and the engine speed of the engine 15 exceeds the speed threshold (speed threshold V1 or V2). Each of the speed thresholds V1 and V2 is an engine speed less than the engine speed of the engine 15 when the load applied to the tilt cylinder 36 is the fixed load. As was described in regard to the second example of the speed reduction control, the ECU 20 varies the speed threshold V2 based on the angle detection value input from the angle detecting device 37. That is, the ECU 20 varies the speed threshold V2 based on the inclination angle of the outboard motor main body 7.

The load applied to the tilt cylinder 36 increases with the increase in the inclination angle of the outboard motor main body 7. Thus, as can be understood from the load curve L1 shown in FIG. 5, the engine speed of the engine 15 when the load applied to the tilt cylinder 36 is the fixed load increases and decreases with the increase and decrease in the inclination angle of the outboard motor main body 7. With the second example of the speed reduction control, the speed threshold V2 is set to vary in the same manner as the engine speed of the engine 15 (the engine speed along the load reference line L3 shown in FIG. 5) when the load applied to the tilt rod 41 is of the fixed value. The range in which the engine speed of the engine 15 is forcibly reduced is thereby reduced in comparison to the case in which the speed threshold is fixed (in comparison to the case of using the speed threshold V1).

Also, in the present preferred embodiment, the ECU 20 includes the storage device 44. The seizing information of the lever 43 is stored in the storage device 44. Here, a case shall be assumed where, for example, the marine vessel 1 is anchored offshore with the supply of power to the outboard motor 2 being stopped, the lever 43 of the angle detecting device 37 being seized at a pivoting angle for a state in which the inclination angle of the outboard motor main body 7 is in the tilt range, and the actual inclination angle of the outboard motor main body 7 being in the trim range. In this case, the inclination angle of the outboard motor main body 7 is in the trim range and it is thus expected that, when the outboard motor 2 is started again, an operation of making the marine vessel 1 run without driving the PTT mechanism 9 will be performed. In this case, the switch operation for driving the PTT mechanism 9 is not performed and the judgment of whether or not the angle detection value of the PTT mechanism 9 has changed is thus not made and it thus cannot be judged whether or not the lever 43 is seized based on the change of the angle detection value after the outboard motor 2 is restarted.

However, with the present preferred embodiment, the storage device 44 is a non-volatile memory, and thus, in the case in which the seizing information of the lever 43 is stored in the storage device 44 before the stopping of the supply of power to the outboard motor 2, the information will be held in the storage device 44 even after the outboard motor 2 is restarted. Thus, in this case, even if the PTT mechanism 9 is not driven (even if the switch operation for driving the PTT mechanism 9 is not performed) after the outboard motor 2 is restarted, the ECU 20 judges that the lever 43 is seized and ends the protection control. Forcible reductions in the engine speed of the engine 15, due to the erroneous judgment that the inclination angle of the outboard motor main body 7 is within the predetermined angular range R1 for performing the protection control despite the actual inclination angle of the outboard motor main body 7 being in the trim range after the restarting of the outboard motor 2, can thus be prevented. Forcible reductions in the propulsive force during ordinary marine vessel running can thereby be prevented.

Although preferred embodiments of the present invention have been described above, the present invention is not restricted to the contents of the above-described preferred embodiments and various modifications are possible within the scope of the claims.

For example, the case in which the engine speed of the engine 15 is decreased preferably by the ECU 20 making the engine 15 misfire was described above with respect to a preferred embodiment of the present invention. However, the ECU 20 may decrease the engine speed of the engine 15 by another method. Specifically, the ECU 20 may decrease the engine speed of the engine 15, for example, by delaying ignition timings in the respective cylinders 24, reducing an injection amount of fuel injected from a fuel injector, or decreasing the opening degree of a throttle valve.

Also, with the above-described preferred embodiments, the case in which the ECU 20 decreases the engine speed of the engine 15 preferably by making a maximum of three of the cylinders 24 misfire was described. However, the maximum number of the cylinders 24 made to misfire by the ECU 20 may be changed according to the number of the cylinders 24 provided in the engine 15.

Also, with the above-described preferred embodiments, the case in which the upper limit angle θ2 preferably is an angle equal to the full tilt-up angle θup (the maximum value of the inclination angle of the outboard motor main body 7) was described. However, the upper limit angle θ2 may be an angle that exceeds the full tilt-up angle θup or an angle less than the full tilt-up angle θup. That is, it suffices that the upper limit angle θ2 be an angle less than the abnormal angle θ3.

Also, with the above-described preferred embodiments, the case in which two trim cylinders 35 are preferably provided was described. However, the number of the trim cylinder 35 may be one or may be three or more. Also, the trim cylinder 35 does not have to be provided. In this case, a plurality of the tilt cylinders 36 may be provided. With the above-described preferred embodiments, the case in which the tilt cylinder is coupled to the swivel bracket and the trim cylinders are arranged to contact the swivel bracket was described. However, the tilt cylinder may be coupled directly to the outboard motor main body without provision of the swivel bracket. For example, two tilt cylinders may be provided as the pivoting mechanism and these may be coupled directly to the outboard motor main body.

The correspondence between the components mentioned in the "SUMMARY OF THE INVENTION" and the components of the above-described preferred embodiment are as follows.

marine vessel: marine vessel 1
outboard motor: outboard motor 2
hull: hull 3
outboard motor main body: outboard motor main body 7
attachment mechanism: attachment mechanism 8
pivoting mechanism: PTT mechanism 9
fixed member: clamp bracket 11
horizontal shaft: tilt shaft 13
engine: engine 15
forward-reverse switching mechanism: forward-reverse switching mechanism 19
controller: ECU 20 rotation speed detecting device: rotation speed detecting device 25
first cylinder: tilt cylinder 36
second cylinder: trim cylinder 35
angle detecting device: angle detecting device 37
first angle: full trim-in angle θin
second angle: full tilt-up angle θup
third angle: full trim-out angle θout
fourth angle: lower limit angle θ1

The present application corresponds to Japanese Patent Application No. 2010-111105 filed in the Japan Patent Office on May 13, 2010, and the entire disclosure of this application is incorporated herein by reference.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. An outboard motor comprising:

an outboard motor main body including an engine which is arranged to generate a propulsive force that propels a hull;

an attachment mechanism including at least a fixed member arranged to be fixed to the hull and a horizontal shaft coupled to the fixed member, the attachment mechanism arranged to attach the outboard motor main body to the hull such that the outboard motor main body pivots about the horizontal shaft;

a pivoting mechanism including a first cylinder arranged to support and pivot the outboard motor main body about the horizontal shaft from a first angle to a second angle greater than the first angle, the pivoting mechanism arranged to pivot the outboard motor main body about the horizontal shaft to incline the outboard motor main body with respect to the fixed member;

an angle detecting device arranged to output an angle detection value corresponding to an inclination angle of the outboard motor main body with respect to the fixed member, the angle detecting device arranged to output the angle detection value corresponding to the inclination angle less than the first angle or the angle detection value corresponding to the inclination angle greater than the second angle when an abnormality occurs in the angle detecting device;

a rotation speed detecting device arranged to output a speed detection value corresponding to an engine speed of the engine; and a controller arranged and programmed to acquire the angle detection value output by the angle detecting device and the speed detection value output by the rotation speed detecting device, the controller arranged and programmed to execute, in accordance with the angle detection value and the speed detection value, a speed reduction control to control the engine so as to reduce the engine speed, the controller arranged and programmed not to execute the speed reduction control when the angle detection value is a value corresponding to the inclination angle less than the first angle or a value corresponding to the inclination angle greater than the second angle.

2. The outboard motor according to claim 1, wherein the pivoting mechanism includes a second cylinder arranged to support and pivot the outboard motor main body about the horizontal shaft from the first angle to a third angle greater than the first angle and less than the second angle;

the controller is arranged and programmed to execute the speed reduction control when the angle detection value is a value corresponding to the inclination angle greater than the third angle and not more than the second angle, and the speed detection value exceeds a first speed value; and the controller is arranged and programmed not to execute the speed reduction control when the angle detection value is a value corresponding to the inclination angle not less than the first angle and not more than the third angle.

3. The outboard motor according to claim 2, wherein the first speed value is a speed detection value corresponding to the engine speed when a load, applied from the outboard motor main body to the pivoting mechanism in a state in which the inclination angle of the outboard motor main body is the second angle, is less than a load at which at least one component among the pivoting mechanism, the attachment mechanism, and the hull breaks.

4. The outboard motor according to claim 2, wherein the controller is arranged and programmed to vary the first speed value based on the angle detection value input from the angle detecting device.

5. The outboard motor according to claim 4, wherein the first speed value is a speed detection value corresponding to the engine speed when the load, applied from the outboard motor main body to the pivoting mechanism in the state in which the inclination angle of the outboard motor main body is greater than the third angle and not more than the second angle, is less than the load at which at least one component among the pivoting mechanism, the attachment mechanism, and the hull breaks, the first speed value includes a plurality of values, and each of the plurality of values is determined according to the inclination angle of the outboard motor main body.

6. The outboard motor according to claim 2, wherein the controller is arranged and programmed to execute the speed reduction control when the speed detection value exceeds the first speed value, and the angle detection value is a value corresponding to the inclination angle that is not more than the second angle and not less than a fourth angle which is greater than the third angle and less than the second angle.

7. The outboard motor according to claim 1, wherein the controller is arranged and programmed not to execute the speed reduction control if the angle detection value input from the angle detecting device does not differ before and after the pivoting mechanism pivots the outboard motor main body.

8. The outboard motor according to claim 1, wherein the outboard motor main body includes a forward-reverse switching mechanism arranged to switch among a plurality of states that include a forward drive state and a reverse drive state; and the controller is arranged and programmed not to execute the speed reduction control when the forward-reverse switching mechanism is not in the forward drive state.

9. A marine vessel comprising:

a hull; and the outboard motor according to claim 1 attached to the hull.

* * * * *